US008460040B2

(12) United States Patent
Ito

(10) Patent No.: US 8,460,040 B2
(45) **Date of Patent: *Jun. 11, 2013**

(54) OUTBOARD MOTOR CONTROL DEVICE AND MARINE VESSEL INCLUDING THE SAME

(75) Inventor: Makoto Ito, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/591,258

(22) Filed: Aug. 22, 2012

(65) Prior Publication Data

US 2012/0315810 A1 Dec. 13, 2012

Related U.S. Application Data

(63) Continuation of application No. 12/636,973, filed on Dec. 14, 2009, now Pat. No. 8,272,906.

(30) Foreign Application Priority Data

Dec. 17, 2008 (JP) ..... 2008-321079
Dec. 17, 2008 (JP) ..... 2008-321080

(51) Int. Cl.
*B63H 25/42* (2006.01)
*B63H 25/04* (2006.01)
*B63H 20/00* (2006.01)
*B63H 20/08* (2006.01)

(52) U.S. Cl.
USPC ..... 440/1; 440/53; 440/87; 114/144 RE; 701/21

(58) Field of Classification Search
USPC ... 114/144 R, 144 RE; 440/1, 53, 61 S–61 C, 440/84, 87; 701/21
See application file for complete search history.

(56) References Cited

U.S. PATENT DOCUMENTS 4,822,307 A * 4/1989 Kanno ..... 440/1
7,367,854 B2 * 5/2008 Arvidsson ..... 440/1

(Continued)

FOREIGN PATENT DOCUMENTS

JP 49-141594 U 12/1974
JP 62-237034 A 10/1987

(Continued)

OTHER PUBLICATIONS

Official Communication issued in corresponding Japanese Patent Application No. 2008-321080, mailed on Oct. 4, 2012.

(Continued)

*Primary Examiner* — Ajay Vasudeva
(74) *Attorney, Agent, or Firm* — Keating & Bennett, LLP

(57) ABSTRACT

An outboard motor control device is arranged to control a plurality of outboard motors. The outboard motor control device includes a malfunction determination unit arranged to determine whether any of the outboard motors is malfunctioning in turning angle control, a turning angle control stop unit arranged to stop turning angle control of an outboard motor determined as malfunctioning in turning angle control by the malfunction determination unit, a turning angle range limitation unit arranged to limit a turning angle range of other normally functioning outboard motor according to a turning angle of the outboard motor malfunctioning in turning angle control, and a turning angle control unit arranged to perform turning angle control of the normally functioning outboard motor in the turning angle range limited by the turning angle range limitation unit.

12 Claims, 24 Drawing Sheets

TURNING ANGLE CONTROL OF CENTRAL OUTBOARD MOTOR IS MALFUNCTIONING

MOVE CENTRAL OUTBOARD MOTOR TO NEUTRAL POSITION

U.S. PATENT DOCUMENTS

| | | | | |
|---|---|---|---|---|
| 8,272,906 | B2 * | 9/2012 | Ito | 440/1 |
| 2007/0068438 | A1 | 3/2007 | Mizutani | |
| 2008/0085640 | A1 | 4/2008 | Ishida et al. | |

FOREIGN PATENT DOCUMENTS

| | | | |
|---|---|---|---|
| JP | 2006-321422 | A | 11/2006 |
| JP | 2007-091115 | A | 4/2007 |
| JP | 2008-087736 | A | 4/2008 |

OTHER PUBLICATIONS

Ito; "Outboard Motor Control Device and Marine Vessel Including the Same"; U.S. Appl. No. 12/626,973, filed Dec. 14, 2009.

* cited by examiner

TURNING ANGLE CONTROL OF CENTRAL OUTBOARD MOTOR IS MALFUNCTIONING

MOVE CENTRAL OUTBOARD MOTOR TO NEUTRAL POSITION

OUTBOARD MOTOR CONTROL DEVICE AND MARINE VESSEL INCLUDING THE SAME

BACKGROUND OF THE INVENTION

1. Field of the Invention

The present invention relates to an outboard motor control device arranged to control a plurality of outboard motors, and a marine vessel including the same.

2. Description of Related Art

An outboard motor is a propulsion device for a marine vessel, and generally includes a motor and a propeller to be driven by the motor. The outboard motor is attached to the stern so as to be turnable in the left-right direction. To control the turning angle of the outboard motor, the marine vessel is equipped with a turning mechanism. The turning mechanism turns the outboard motor according to an operation of a steering handle performed by a steering operator. In a case of a multiple-outboard motor arrangement in which a plurality of outboard motors are attached to the stern, the turning mechanism turns the plurality of outboard motors synchronously.

United States Patent Application Publication No. US 2007/0068438 A1 discloses an arrangement in which a steering angle of a steering handle is detected by a steering angle sensor, and according to the detection result, two outboard motors are turned. US 2007/0068438 A1 discloses a control for performing a marine vessel turning operation based only on an output difference between the outboard motors and fixing a turning angle of the outboard motors when the steering device is malfunctioning.

SUMMARY OF THE INVENTION

The inventors of preferred embodiments of the present invention described and claimed in the present application conducted an extensive study and research regarding an outboard motor control device, such as the one described above, and in doing so, discovered and first recognized new unique challenges and previously unrecognized possibilities for improvements as described in greater detail below.

Specifically, in the arrangement of US 2007/0068438 A1, not only the turning angle of the outboard motor for the steering device which is malfunctioning but also the turning angle of the outboard motor for a normal steering device is fixed, and turning performance of the marine vessel is secured only by an output difference between the outboard motors. However, the arrangement sacrifices a propulsion force to secure the turning performance of the marine vessel, and hence a running speed of the marine vessel is sacrificed. Further, the propulsion force must be controlled according to the steering angle of the steering handle, so that the control becomes complicated. In order to overcome the previously unrecognized and unsolved challenges described above, a preferred embodiment of the present invention provides an outboard motor control device arranged to control a plurality of outboard motors, including a malfunction determination unit arranged to determine whether any of the outboard motors is malfunctioning in performance of turning angle control to thereby identify a malfunctioning outboard motor, a turning angle control stop unit arranged to stop turning angle control of the malfunctioning outboard motor, a turning angle range limitation unit arranged to limit a turning angle range of a normally functioning outboard motor or motors according to a turning angle of the malfunctioning outboard motor, and a turning angle control unit arranged to perform turning angle control of the normally functioning outboard motor(s) within the turning angle range limited by the turning angle range limitation unit.

With this arrangement, when any of the outboard motors is malfunctioning in turning angle control, the turning angle control of this outboard motor is stopped. Then, according to a turning angle of the malfunctioning outboard motor, a turning angle range of another normally functioning outboard motor(s) which (is not malfunctioning in turning angle control) is limited. Turning angle control of the normally functioning outboard motor(s) is performed in the limited turning angle range. Thus, even when any of the outboard motors is malfunctioning in turning angle control, turning angle control of the other normally functioning outboard motor(s) is continued although the turning angle control is performed in the limited turning angle range. Accordingly, a predetermined or higher running speed can be secured by using propulsion force of the normally functioning outboard motor (s), and turning performance of a marine vessel can be secured by turning angle control of the normally functioning outboard motor(s).

Examples of malfunctioning in turning angle control include a malfunction of a turning mechanism arranged to turn an outboard motor, a malfunction of a turning angle sensor arranged to detect a turning angle, disconnection and short circuit of a signal line from a turning angle sensor to a controller, and a malfunction (disconnection and short circuit, etc.) of a control signal transmission system from a controller to a turning mechanism, etc.

The turning angle range limitation unit is preferably arranged to limit a turning angle range of the normally functioning outboard motor(s) to a maximum range capable of avoiding mechanical interference with a malfunctioning outboard motor, the turning angle control of which is being stopped. Accordingly, turning performance of a marine vessel can be maximized.

The outboard motor control device of a preferred embodiment of the present invention further includes a non-interference control unit arranged to turn the malfunctioning outboard motor to a predetermined non-interference turning angle that prevents the malfunctioning outboard motor from interfering with the operation of the other normally functioning outboard motor(s). In this case, preferably, the turning angle control stop unit is preferably arranged to stop turning angle control of the malfunctioning outboard motor after the malfunctioning outboard motor is turned to the non-interference turning angle.

In some cases in which the turning angle control is malfunctioning, the outboard motor is turnable. This corresponds to, for example, a case in which the turning speed becomes slower (response failure) due to an increase in mechanical resistance (friction, etc.) when turning by the turning mechanism. In this case, the malfunctioning outboard motor is preferably moved to a non-interference position so as to prevent the malfunctioning outboard motor from interfering with and limiting the turning range and ability of other normally functioning outboard motor(s) before stopping the turning control. Accordingly, the maximum turning angle range of the normally functioning outboard motor(s) can be secured, so that turning performance of the marine vessel is easily secured.

The outboard motor control device preferably further includes a turnability determination unit arranged to determine whether the malfunctioning outboard motor is turnable. In this case, the non-interference control unit is preferably arranged to turn the malfunctioning outboard motor to the non-interference turning angle when the malfunctioning outboard motor is determined to be turnable. Also, the turning angle control stop unit is preferably arranged to stop the turning angle control of the malfunctioning outboard motor without waiting for the malfunctioning outboard motor to be turned to the non-interference turning angle when the malfunctioning outboard motor is determined to be not turnable.

With this arrangement, when any of the outboard motors is malfunctioning in turning angle control, it is determined whether the malfunctioning outboard motor is turnable. When it is turnable, the malfunctioning outboard motor is turned to the non-interference turning angle. Accordingly, the maximum turning angle range of other normally functioning outboard motor(s) can be secured. When it is determined that the malfunctioning outboard motor is not turnable, the malfunctioning outboard motor is stopped at the turning angle position as of the time when the outboard motor is determined to be malfunctioning. According to this stop position, the turning angle range of other normally functioning outboard motor(s) is limited.

The non-interference turning angle is preferably set to an end of the turning angle range so that the malfunctioning outboard motor is spaced as far away as possible from the other normally functioning outboard motor(s).

With this arrangement, when any of the outboard motors is malfunctioning in turning angle control, this malfunctioning outboard motor is turned to an end of the turning angle range. Accordingly, the maximum turning angle range can be secured for the other normally functioning outboard motor(s), so that turning performance of the marine vessel can be easily secured.

Particularly, when a plurality of outboard motors are aligned, for an outboard motor disposed at the extreme end in the alignment direction, a non-interference turning angle is preferably set to an end of the turning angle range. In detail, when a plurality of outboard motors are aligned in the left-right direction of the marine vessel, for an outboard motor on the right end, a maximum right turning angle is determined as a non-interference turning angle, and for an outboard motor on the left end, a maximum left turning angle is determined as a non-interference turning angle. Accordingly, a maximum turning angle range can be secured for other outboard motor (s) adjacent to the outboard motor on the right end or the left end.

The non-interference turning angle may be set to the center of the turning angle range in certain cases.

When an outboard motor that is malfunctioning in turning angle control has other outboard motors on both sides thereof, by moving the malfunctioning outboard motor to a non-interference position at the center of the turning angle range, certain turning angle ranges can be secured for the outboard motors on both sides.

Further, the non-interference turning angle may be set individually for the plurality of outboard motors.

In detail, the non-interference turning angle of the outboard motor disposed on one end in the alignment direction is preferably set to the corresponding one-side maximum turning angle of the turning angle range. A non-interference turning angle of the outboard motor to both sides of which other outboard motors are adjacent is preferably set to the central turning angle of the turning angle range.

In a preferred embodiment of the present invention, the outboard motor control device is arranged to control turning actuators arranged to individually turn the plurality of outboard motors, and the outboard motor control device further includes a non-interference control unit which is arranged to move the malfunctioning outboard motor to a non-interference position by turning the malfunctioning outboard motor until a load of the corresponding turning actuator reaches a predetermined value, and the turning angle control stop unit is arranged to stop turning angle control of the malfunctioning outboard motor after the malfunctioning outboard motor is moved to the non-interference by the non-interference control unit.

With this arrangement, when any of the outboard motors is malfunctioning in turning angle control, the malfunctioning outboard motor is turned until a load of the turning actuator corresponding to the outboard motor reaches a predetermined value. Accordingly, the outboard motor is moved as much as possible to a non-interference position so as not to obstruct turning of the other normally functioning outboard motor(s). In detail, when the malfunctioning outboard motor is turned to a mechanical turning limit, the load of the corresponding turning actuator increases. Accordingly, the malfunctioning outboard motor is moved to the mechanical turning limit. In other words, a turning angle corresponding to the mechanical turning limit is a non-interference turning angle.

The turning actuator may be an electric actuator (for example, an electric motor). In this case, the malfunctioning outboard motor may be turned until a load current reaches a predetermined value, and then, the turning angle control may be stopped.

Preferably, the outboard motor control device further includes a propulsion force control unit arranged to stop generation of a propulsion force of the malfunctioning outboard motor before turning the malfunctioning outboard motor.

With this arrangement, when any of the outboard motors is malfunctioning in turning angle control, propulsion force generation of the malfunctioning outboard motor is stopped, and then the outboard motor is moved to the non-interference turning angle. Accordingly, when the malfunctioning outboard motor is moved to the non-interference position and non-interference turning angle, application of a propulsion force in a direction which a steering operator does not intend the marine vessel to go can be avoided.

A preferred embodiment of the present invention provides a marine vessel including a hull, a plurality of outboard motors installed in the hull, and an outboard motor control device which is arranged to control the plurality of outboard motors and has features described above.

With this arrangement, when any of the outboard motors is malfunctioning in turning angle control, while turning angle control of the malfunctioning outboard motor is stopped, turning angle control of other normally functioning outboard motor(s) is continued. Accordingly, a certain or higher running speed can be secured by using most of the propulsion force generated by the normally functioning outboard motor(s), and turning performance of the marine vessel can be secured by turning angle control of the normally functioning outboard motor(s).

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
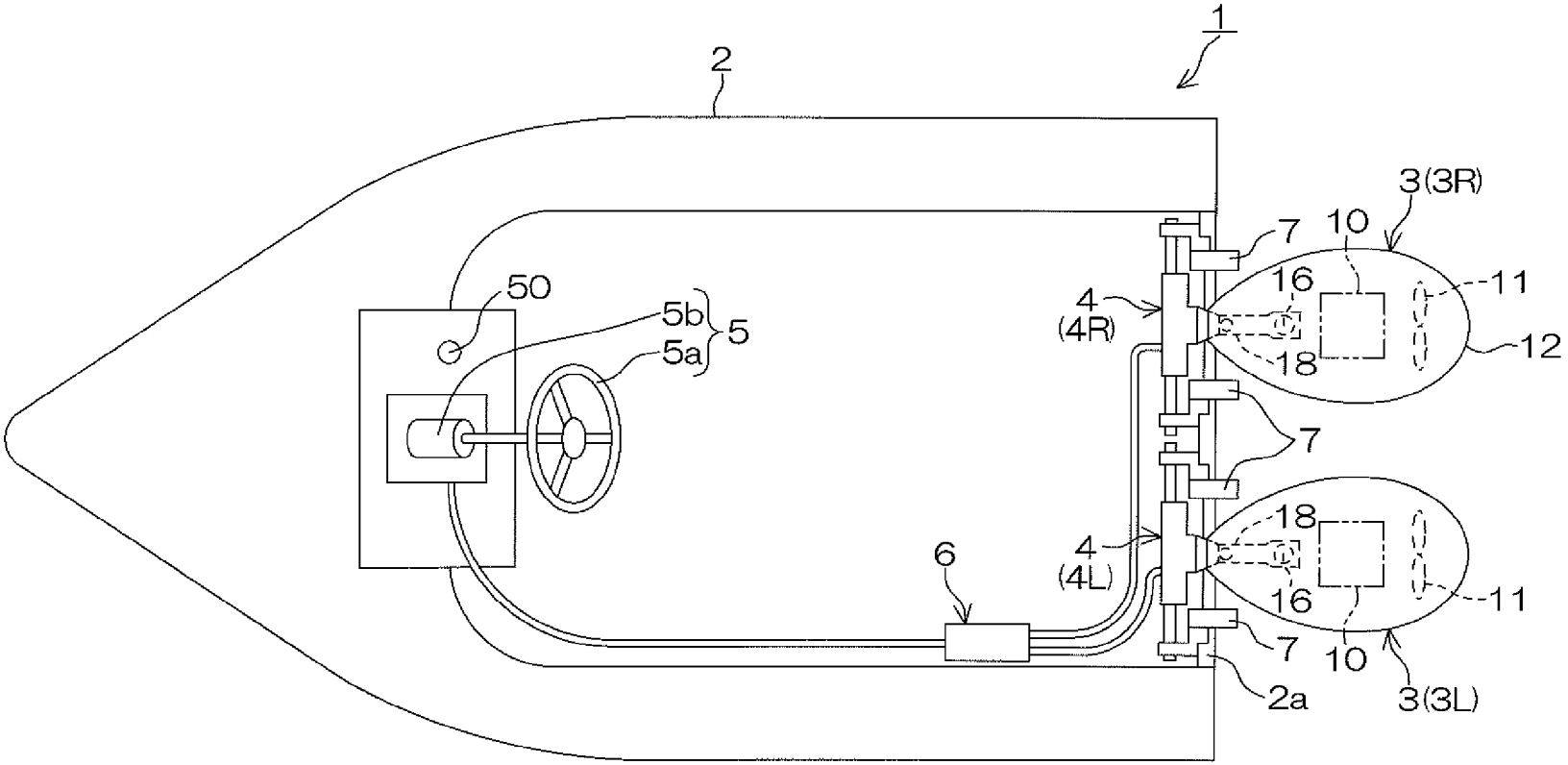
FIG. 1 is an illustrative plan view for describing an arrangement of a marine vessel of a first preferred embodiment of the present invention.

FIG. 1 is an illustrative plan view for describing an arrangement of a marine vessel of a first preferred embodiment of the present invention. The marine vessel 1 includes a hull 1, a hull 2, a pair of outboard motors 3, a pair of turning mechanisms 4, an operation unit 5, and a controller 6.

The pair of outboard motors 3 includes a starboard outboard motor 3R disposed on the starboard of the stern of the hull, and a portside outboard motor 3L disposed on the portside of the stern of the hull. A pair of outboard motors 3 is attached side by side laterally to a transom 2*a* of the hull 2, and are capable of swinging (turning) in the left-right direction. The outboard motor 3 includes an engine (internal combustion) 10 as a motor, and a propeller 11 to be driven to rotate by the engine 10. An upper portion accommodating the engine 10 is protected by a top cowling or engine cover 12. The top cowling 12 has a streamlined (drop-shaped) external form in a plan view, and the top cowling 12 defines an external shape of the outboard motor 3 in a plan view. In other words, the outboard motor 3 has an external shape in a plan view, which becomes wider as it goes to the rear side (to be exact, as it separates from the swing center).

The pair of turning mechanisms 4 includes a portside turning mechanism 4L corresponding to the portside outboard motor 3L, and a starboard turning mechanism 4R corresponding to the starboard outboard motor 3R. The portside turning mechanism 4L swings (turns) the portside outboard motor 3L to the left and right. The starboard turning mechanism 4R swings (turns) the starboard outboard motor 3R to the right and left.

The operation unit 5 includes a steering handle 5*a* arranged to be operated by a steering operator, and a steering angle sensor 5*b* arranged to detect a steering angle (operation angle) of the steering handle 5*a*. An output signal of the steering angle sensor 5*b* is input into the controller 6.

The controller 6 is an electronic control unit (ECU), and includes a microcomputer. The controller 6 controls operations of the turning mechanisms 4 according to a steering angle detected by the steering angle sensor 5*b*. The controller 6 also has a function of controlling an output of the engine 10 although the control system is not shown.

Figure 2:
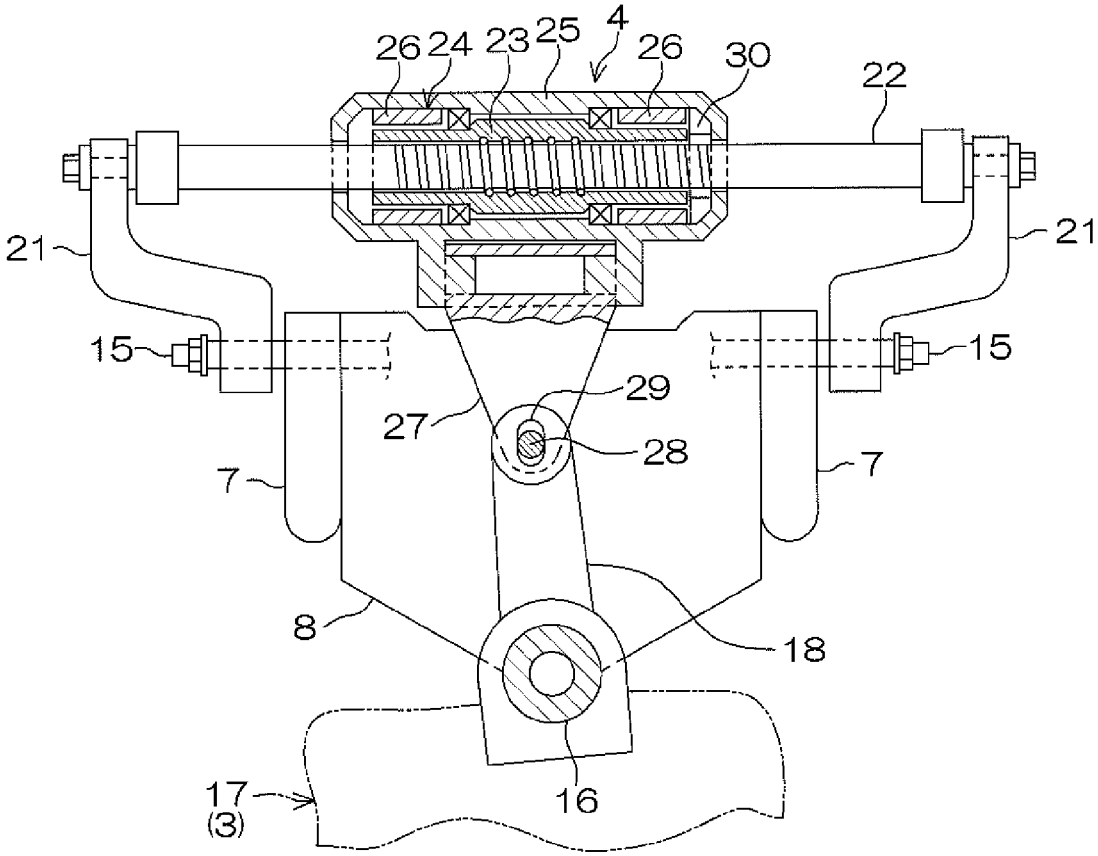
FIG. 2 is a sectional plan view for describing an arrangement of a turning mechanism.

FIG. 2 is a sectional plan view for describing an arrangement of the turning mechanism 4. The outboard motor 3 is attached to a transom 2*a* (see FIG. 1) of the hull 2 via a clamp bracket 7 and a swivel bracket 8. In detail, the clamp bracket 7 is fixed to the transom 2*a*, and the swivel bracket 8 is coupled to the clamp bracket 7. Further, the outboard motor 3 is attached to the swivel bracket 8 so as to be swingable (turnable) in the left and right direction. In greater detail, the clamp bracket 7 supports the swivel bracket 8 turnably in the up-down direction via a tilt shaft 15 extending in the left-right direction. The swivel bracket 8 has a steering shaft 16 erected on the rear end of the swivel bracket. On this steering shaft 16, a main body 17 of the outboard motor 3 is supported so as to be turnable in the left and right direction.

The outboard motor main body 17 is provided with a steering bracket 18 extending and projecting forward of the steering shaft 16. By swinging the steering bracket 18 around the steering shaft 16, the outboard motor 3 can be turned to the left and right with respect to the swivel bracket 8.

The left and right outboard motors 3L and 3R are not mechanically coupled to each other, but can be turned independently of each other. However, the left and right outboard motors 3L and 3R are disposed close to each other, so that disordered turning may cause these outboard motors to collide with each other. To prevent these types of collisions, the left and right turning mechanisms 4L and 4R are controlled by the controller 6.

The turning mechanism 4 includes a pair of left and right support members 21, a ball screw shaft 22, a ball screw nut 23, and a turning motor 24 as a turning actuator. The pair of support members 21 is supported turnably on the clamp bracket 7 via a tilt shaft 15. The ball screw shaft 22 is laid across these support members 21. The ball screw nut 23 is screwed on the ball screw shaft 22. The turning motor 24 rotates the ball screw nut 23 around the ball screw shaft 22, and has a housing 25 arranged to house the ball screw nut 23. Hereinafter, when the turning motors 24 corresponding to the portside turning mechanism 4L and the starboard turning mechanism 4R are distinguished from each other, they are referred to as "portside turning motor 24L" and "starboard turning motor 24R," respectively.

The ball screw shaft 22 is supported by the support members 21 such that an axis thereof is along the left-right direction of the hull 2. The ball screw nut 23 is supported rotatably inside the housing 25, and is restricted from moving in the axial direction of the housing 25 (parallel to the axial direction of the ball screw shaft 22).

The turning motor 24 includes stators 26 fixed inside the housing 25, and by energizing coils (not shown) of the stators 26, the stators are arranged to drive and rotate the ball screw nut 23 as a rotor. This rotation of the turning motor 24 is controlled by the controller 6. Inside the housing 25, a turning angle sensor 30 arranged to detect a turning angle of the outboard motor 3 by detecting the rotation of the ball screw nut 23 is provided. The turning angle sensor 30 may include, for example, a gap sensor arranged to detect a number of grooves (ridges) formed on the outer peripheral surface of the ball screw nut based on magnetic flux changes. Hereinafter, when the turning angle sensors 30 attached to the portside turning mechanism 4L and the starboard turning mechanism 4R are distinguished from each other, they are referred to as "portside turning angle sensor 30L" and "starboard turning angle sensor 30R," respectively.

The housing 25 includes a turning arm 27 extending rearward toward the outboard motor 3. A joint pin 28 is erected at the rear end of the turning arm 27. A slot 29 formed in a tip end of a steering bracket 18 is freely fitted around the joint pin 28. Accordingly, the steering bracket 18 is joined to the turning arm 27 turnably.

With this arrangement, when the ball screw nut 23 is rotated by the turning motor 24, the ball screw nut 23 moves in the left-right direction along the ball screw shaft 22. Accordingly, the housing 25 is caused to move in the left-right direction, and the steering bracket 18 coupled to the turning arm 27 swings around the steering shaft 16. As a result, turning of the outboard motor 3 coupled to the steering bracket 18 is performed.

Figure 3:
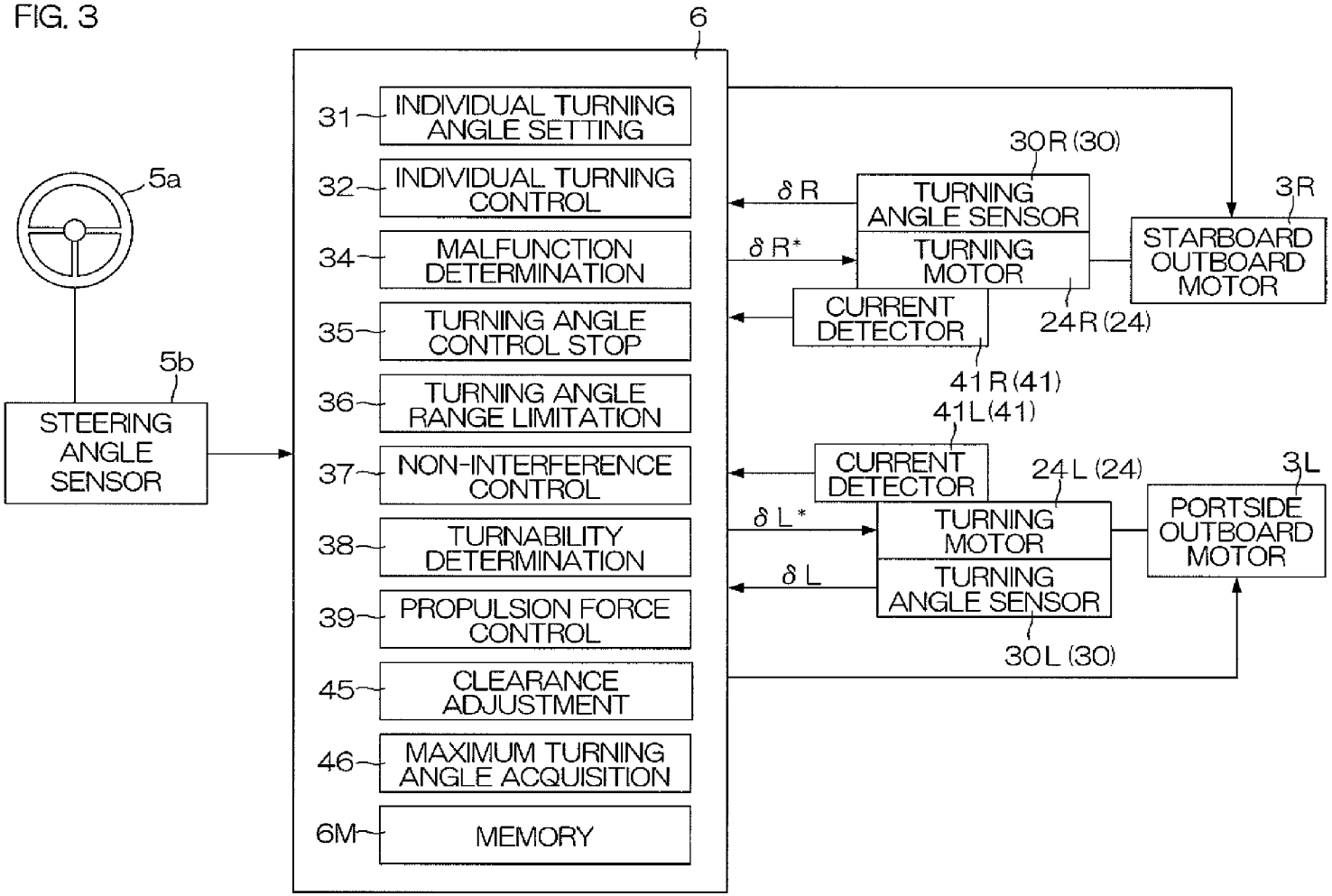
FIG. 3 is a block diagram for describing an electric arrangement concerning turning controls of the marine vessel.

FIG. 3 is a block diagram for describing an electric arrangement concerning turning controls of the marine vessel. Output signals of the steering angle sensor 5*b* and the left and right turning angle sensors 30L and 30R are input into the controller 6. Based on these signals, the controller 6 controls the turning motors 24L and 24R provided in the left and right turning mechanisms 4L and 4R.

The controller 6 includes a CPU and a memory, and realizes functions as a plurality of function processing units by executing a predetermined program. In detail, the controller 6 is programmed to execute functions as an individual turning angle setting unit 31, an individual turning control unit 32, a malfunction determination unit 34, a turning angle control stop unit 35, a turning angle range limitation unit 36, a non-interference control unit 37, a turnability determination unit 38, a propulsion force control unit 39, a clearance adjustment unit 45, and a maximum turning angle acquisition unit 46.

The function as the individual turning angle setting unit 31 includes a function of individually setting a target turning angle δL* of the portside outboard motor 3L and a target turning angle δR* of the starboard outboard motor 3R. The function as the individual turning control unit 32 includes a function of individually performing turning controls of the portside outboard motor 3L and the starboard outboard motor 3R according to the individually set target turning angles δL* and δR*. The function as the malfunction determination unit 34 includes a function of determining whether the outboard motors 3 are malfunctioning in turning angle control. The function as the turning angle control stop unit 35 includes a function of stopping turning angle control of an outboard motor 3 determined to be malfunctioning in the turning angle control. The function as the turning angle range limitation unit 36 includes a function of limiting a turning angle range of the other outboard motor (normally functioning outboard motor) which is not malfunctioning in turning angle control according to a turning angle of the malfunctioning outboard motor, the turning angle control of which is being stopped. After the turning angle range is limited, the individual turning control unit 32 is arranged to perform turning angle control of the normally functioning outboard motor in the limited turning angle range. The function as the non-interference control unit 37 includes a function of turning the malfunctioning outboard motor to a predetermined non-interference turning angle. The turnability determination unit 38 includes a function of determining whether the malfunctioning outboard motor is turnable. The function as the propulsion force control unit 39 includes a function of controlling propulsion forces of the outboard motors 3 (including generation/stop of the propulsion forces). The function as the clearance adjustment unit 45 includes a function of performing turning controls of the left and right outboard motors 3L and 3R to cause the clearance between the left and right outboard motors 3L and 3R to be proper. The function as the maximum turning angle acquisition unit 46 includes a function of acquiring a maximum right turning angle and a maximum left turning angle of the portside outboard motor 3L and a maximum right turning angle and a maximum left turning angle of the starboard outboard motor 3R, and a function of storing these angles in a memory 6M. The target turning angles δL* and δR* of the left and right outboard motors 3L and 3R are set within the respective turning angle ranges between the maximum right turning angles and the maximum left turning angles.

The outboard motor 3 is provided with a shift mechanism, and the shift mechanism is controlled to any of the shift positions including a forward drive position, a reverse drive position, and a neutral position. The forward drive position is a shift position for transmitting a driving force of the engine 10 to the propeller 11 to rotate the propeller 11 in a rotational direction in which the propeller 11 generates a propulsion force in the forward drive direction. The reverse drive position is a shift position for transmitting a driving force of the engine 10 to the propeller 11 to rotate the propeller 11 in a rotational direction in which the propeller 11 generates a propulsion force in a reverse drive direction. The neutral position is a shift position at which a driving force of the engine 10 is not transmitted to the propeller 11. Therefore, by controlling the shift position of the shift mechanism to the neutral position, generation of a propulsion force can be stopped. The function as the propulsion force control unit 39 of the controller 6 includes a function of giving commands of shift positions to the outboard motors 3.

Figure 4:
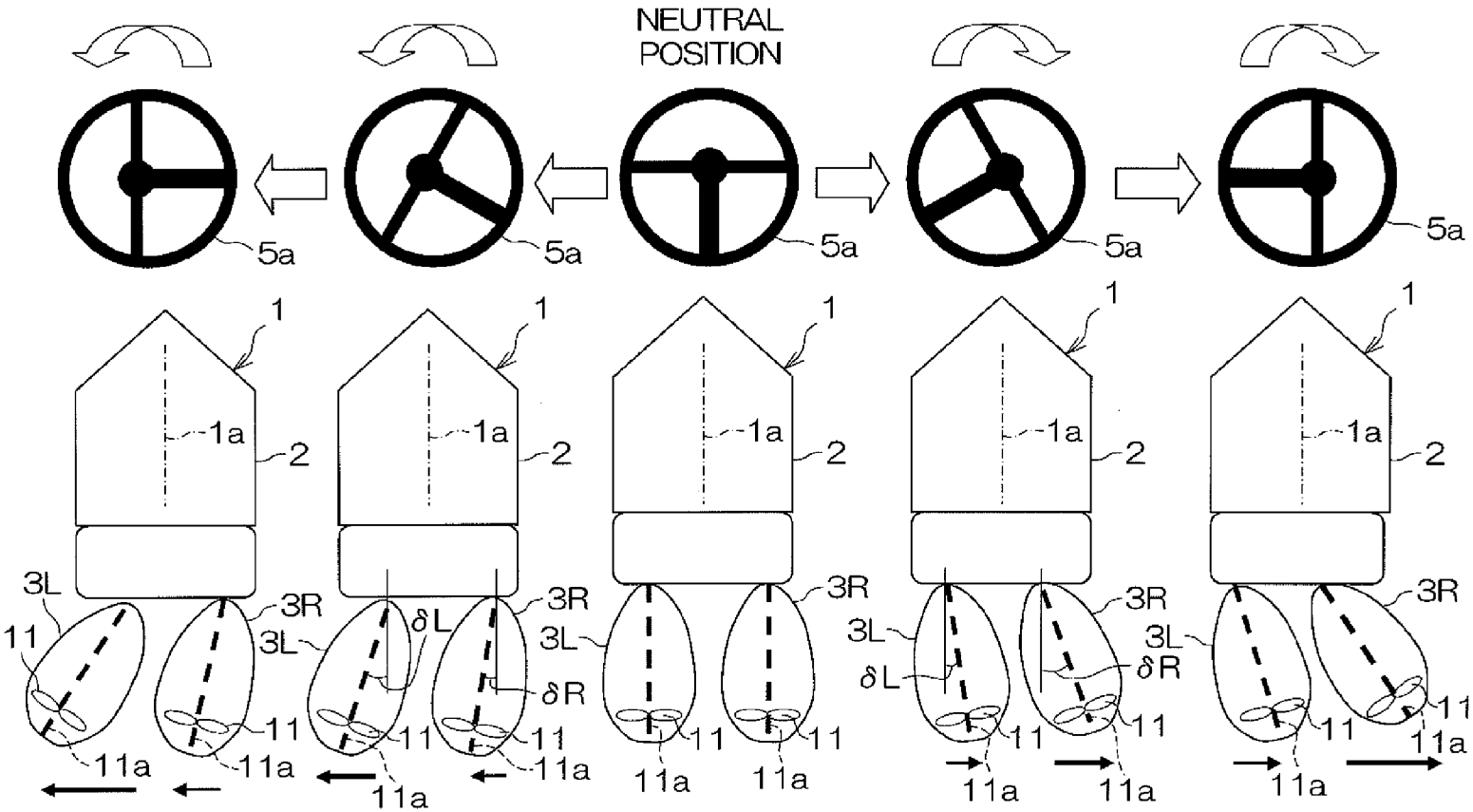
FIG. 4 is an explanatory view illustrating turning angle control of left and right outboard motors.

FIG. 4 is an explanatory view illustrating turning angle control of the left and right outboard motors. When the steering handle 5*a* is at a neutral position, the turning angles δL and δR of the left and right outboard motors 3L and 3R are zero. In other words, the left and right outboard motors 3L and 3R generate propulsion forces in directions parallel or substantially parallel to each other. The turning angle is an angle (in a plan view) of the center line 11*a* of the propeller 11 of the outboard motor 3 with respect to the marine vessel center line 1*a*. The marine vessel center line 1*a* is a straight line passing through the bow and the stern center in the plan view.

When the steering handle 5*a* is operated to rotate clockwise, the turning angles δL and δR of the left and right outboard motors 3L and 3R change accordingly, and the propellers 11 of the outboard motors 3L and 3R are turned to the right with respect to the hull 2. Accordingly, when the outboard motors 3L and 3R are driven forward, propulsion forces of the outboard motors 3L and 3R become leftward with respect to the marine vessel center line 1*a*. As a result, the marine vessel 1 turns to the right. As the operation amount to rotate the steering handle 5*a* clockwise becomes larger, the turning angles δL and δR of the outboard motors 3L and 3R become larger. However, the turning angles δL and δR of the left and right outboard motors 3L and 3R are not equal to each other, and the turning angle δR of the starboard outboard motor 3R is larger than the turning angle δL of the portside outboard motor 3L. The difference between the turning angles δL and δR of the left and right outboard motors 3L and 3R becomes larger as the turning angles δL and δR become larger. This is for avoiding interference of the outboard motors 3L and 3R having external shapes which become wider as it goes toward the rear side in a plan view. Specifically, when the turning angles δL and δR of the outboard motors 3L and 3R are equal to each other, as the turning angles become larger, the clearance between the outboard motors 3L and 3R becomes smaller, and at last, the outboard motors 3L and 3R come into contact with each other. Therefore, in the present preferred embodiment, the target turning angle δR* of the starboard outboard motor 3R positioned on the turning direction downstream side (right side) is set to be larger than the target turning angle δL* of the portside outboard motor 3L positioned on the turning direction upstream side (left side). It should be noted that "the turning angle is large" means that the absolute value of the turning angle is large. The same applies to the target turning angles.

Leftward steering is also the same. That is, when the steering handle 5*a* is operated to rotate counterclockwise, the turning angles δL and δR of the left and right outboard motors 3L and 3R change accordingly, and the propellers 11 of the outboard motors 3L and 3R are turned to the left with respect to the hull 2. Accordingly, when the outboard motors 3L and 3R are driven forward, propulsion forces of the outboard motors 3L and 3R become rightward with respect to the marine vessel center line 1*a*. As a result, the marine vessel 1 turns to the left. As the operation amount to rotate the steering handle 5*a* counterclockwise becomes larger, the turning angles δL and δR of the outboard motors 3L and 3R also become larger. However, the turning angles δL and δR of the left and right outboard motors 3L and 3R are not equal to each other, and the turning angle δL of the portside outboard motor 3L is larger than the turning angle δR of the starboard outboard motor 3R. The difference between the turning angles δL and δR of the left and right outboard motors 3L and 3R becomes larger as the turning angles δL and δR become larger. In other words, in the present preferred embodiment, the target turning angle δL* of the portside outboard motor 3L positioned on the turning direction downstream side (left side) is larger than the target turning angle δR* of the starboard outboard motor 3R positioned on the turning direction upstream side (right side).

Figure 5A:
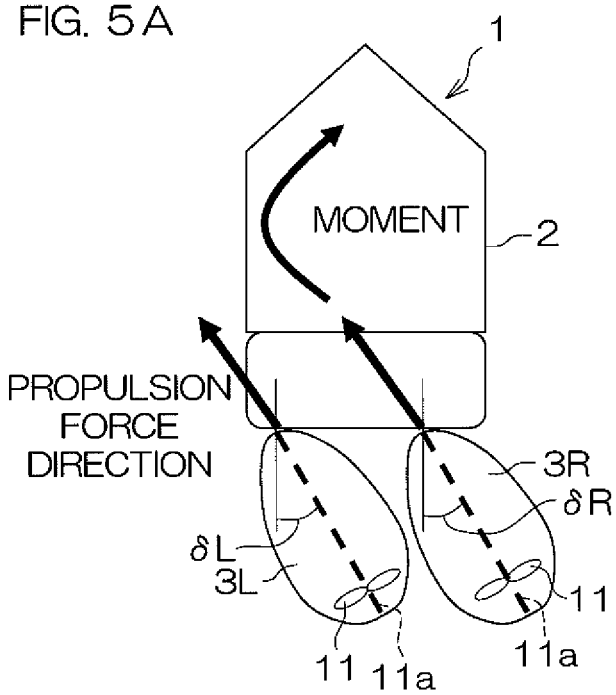
FIG. 5A is a view showing a right turn operation when turning angles of the left and right outboard motors are set to be equal to each other.
Figure 5B:
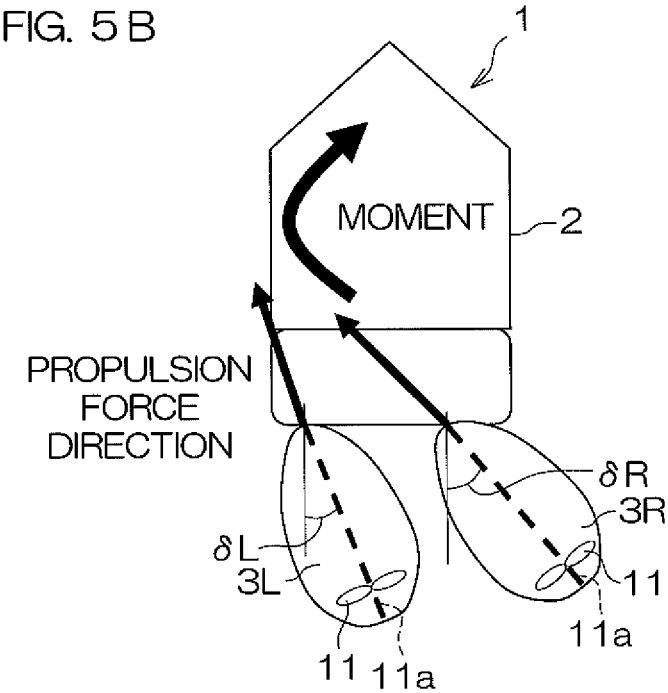
FIG. 5B is a view showing right turn operation when the turning angle of the starboard outboard motor is set to be larger than the turning angle of the portside outboard motor.

FIG. 5A is a view showing a right turn operation when the turning angles of the left and right outboard motors are set to be equal to each other, and FIG. 5B is a view showing a right turn operation when the turning angle of the starboard outboard motor is set to be larger than the turning angle of the portside outboard motor. The turning angles δL of the portside outboard motor in the situations of FIG. 5A and FIG. 5B are equal to each other.

In the situation of FIG. 5B in which the turning angle δR of the starboard outboard motor 3R is set to be larger than the turning angle δL of the portside outboard motor 3L, a moment resulting from propulsion forces generated by the outboard motors 3L and 3R is larger than a moment in the situation of FIG. 5A in which the turning angles δL and δR of the left and right outboard motors 3L and 3R are equal to each other. Therefore, the situation of FIG. 5B achieves more excellent turning performance of the marine vessel 1.

To set the turning angles δL and δR of the outboard motors 3L and 3R equal to each other and avoid mechanical interference of the outboard motors 3L and 3R, the whole turning angle ranges of the outboard motors 3L and 3R are greatly limited. Therefore, in the present preferred embodiment, the turning angle of the outboard motor on the turning direction downstream side is set to be larger than the turning angle of the outboard motor on the turning direction upstream side. Accordingly, the whole turning angle ranges of the outboard motors 3L and 3R can be set to maximum in the ranges which do not cause interference between the outboard motors 3L and 3R, and accordingly, excellent turning performance can be given to the marine vessel 1.

Figure 6:
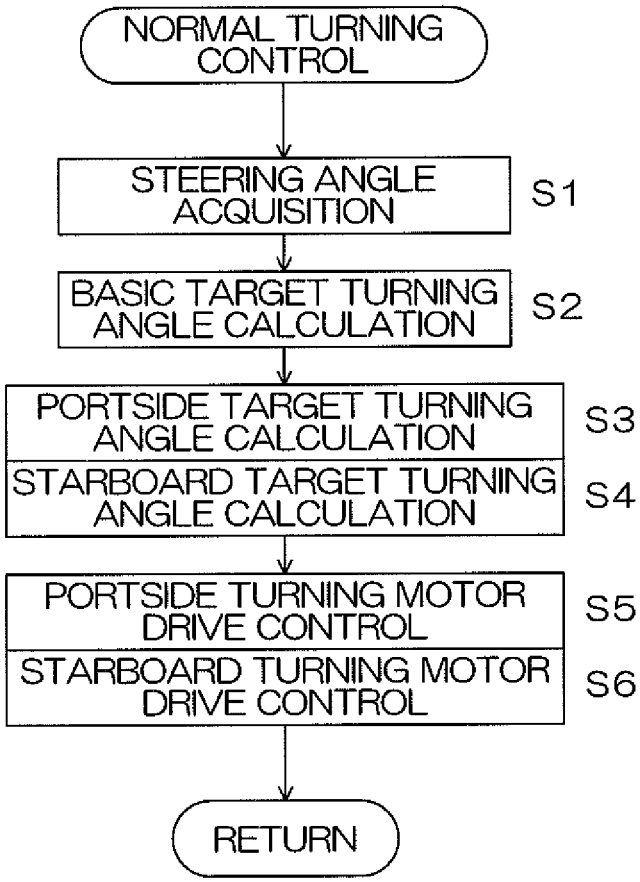
FIG. 6 is a flowchart for describing details of turning controls by a controller.

FIG. 6 is a flowchart for describing details of processing to be performed by the controller 6 for realizing the above-described turning control. The controller 6 acquires a steering angle detected by the steering angle sensor 5*b* (Step S1), and calculates a basic target turning angle δ* corresponding to the acquired steering angle (Step S2). The basic target turning angle δ* is a target turning angle calculated without considering interference between the outboard motors 3L and 3R.

Next, the controller 6 calculates a target turning angle δL* for the portside outboard motor 3L (hereinafter, referred to as "portside target turning angle") and a target turning angle δR* for the starboard outboard motor 3R (hereinafter, referred to as "starboard target turning angle") based on the basic target turning angle δ* (Steps S3 and S4: function as the individual turning angle setting unit 31). These target turning angles δL* and δR* have values obtained by applying necessary corrections to the basic target turning angle δ* so as to avoid interference between the outboard motors 3L and 3R.

When the target turning angles δL* and δR* of the outboard motors 3L and 3R are obtained, the controller 6 controls the turning motors 24L and 24R of the portside turning mechanism 4L and the starboard turning mechanism 4R based on the target turning angles δL* and δR* (Steps S5 and S6: function as the individual turning control unit 32). In detail, the controller 6 performs feedback control of the turning motors 24L and 24R such that the actual turning angles δL and δR of the portside and starboard outboard motors 3L and 3R detected by the turning angle sensors 30L and 30R become equal to the target turning angles δL* and δR*, respectively.

Figure 7:
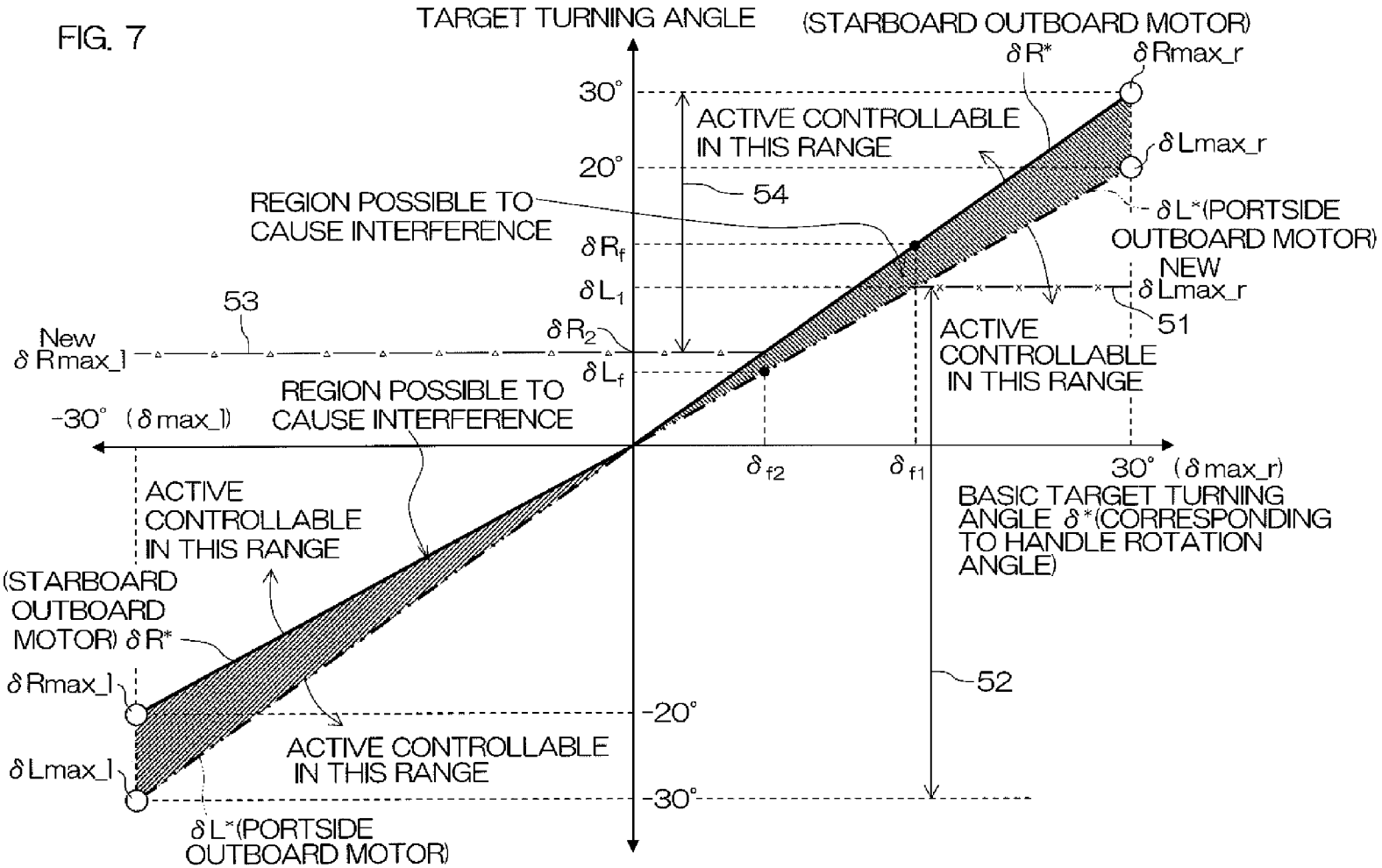
FIG. 7 is a view for describing a setting example of a portside target turning angle and a starboard target turning angle.

FIG. 7 is a view for describing a setting example of the portside target turning angle and the starboard target turning angle. The turning angles are expressed with a positive sign in the case of right turning and a negative sign in the case of left turning. The horizontal axis indicates a basic target turning angle δ* taking a value corresponding to (in proportion to) the steering angle of the steering handle 5*a*. In a range in which the basic target turning angle δ* is positive (rightward steering region), the starboard target turning angle δR* is determined to be equal to the basic target turning angle δ*. On the other hand, the portside target turning angle δL* is determined to be smaller than the basic target turning angle δ*. On the contrary, in a region in which the basic target turning angle δ* is negative (leftward steering region), the portside target turning angle δL* is determined to be equal to the basic target turning angle δ*. On the other hand, the starboard target turning angle δR* is determined such that the absolute value thereof is smaller than the absolute value of the basic target turning angle δ*.

In greater detail, the starboard target turning angle δR* is determined so as to change linearly from zero to a maximum right turning angle δRmax_r (=δmax_r) when the basic target turning angle δ* changes from zero to a maximum right turning angle δmax_r (for example, approximately 30 degrees). Also, the starboard target turning angle δR* is determined so as to change linearly from a maximum left turning angle δRmax_l (|δRmax_l|<|δmax_l|) to zero when the basic target turning angle δ* changes from a maximum left turning angle δmax_l (for example, approximately −30 degrees) to zero. Similarly, the portside target turning angle δL* is determined so as to change linearly from zero to a maximum left turning angle δmax_r (<δmax_r) when the basic target turning angle δ* changes from zero to a maximum right turning angle δmax_r (for example, 30 degrees). Also, the portside target turning angle δL* is determined so as to change linearly from a maximum left turning angle δLmax_l to zero when the basic target turning angle δ* changes from the maximum left turning angle δmax_l (for example, approximately −30 degrees) to zero. The maximum right turning angle δRmax_r of the starboard target turning angle δR* and the maximum right turning angle δLmax_r of the portside target turning angle δL* satisfy the relationship of $\delta Rmax_r - \delta Lmax_r \geqq \epsilon_r$ ($\epsilon_r > 0$). Similarly, the maximum left turning angle δRmax_l of the starboard target turning angle δR* and the maximum left turning angle δLmax_l of the portside target turning angle δL* satisfy the relationship of $|\delta Lmax_l| - |\delta Rmax_l| \geqq \epsilon_l$ ($\epsilon_l > 0$). $\epsilon_R$ and $\epsilon_l$ are values obtained by converting minimum clearances, which should be secured between the outboard motors 3L and 3R when the outboard motors are turned maximally rightward and leftward, into turning angle differences (minimum turning angle difference at maximum turning angles).

Thus, in the right turning angle region, the target turning angle δL* of the portside outboard motor 3L is set to a value smaller than the basic target turning angle δ*. Also, in the left turning angle region, the target turning angle δR* of the starboard outboard motor 3R is set such that the absolute value thereof is smaller than the absolute value of the basic target turning angle δ*. Accordingly, at any turning angle, interference between the outboard motors 3L and 3R can be prevented. Further, a large maximum turning angle can be secured for the outboard motor on the turning direction downstream side, so that the turning performance of the marine vessel 1 can be improved.

It should be noted that the portside target turning angle δL* does not need to be set according to the characteristic line shown by the phantom line in FIG. 7, and may be set to a value belonging to the region under the characteristic line. Similarly, the starboard target turning angle δR* does not need to be set according to the characteristic line shown by the solid line in FIG. 7, and may be set to a value belonging to the region higher than the characteristic line. In other words, out of the region which may cause interference between the outboard motors 3L and 3R, the portside target turning angle δL* and the starboard target turning angle δR* according to the basic target turning angle δ* may be individually set (active control).

Figure 8:
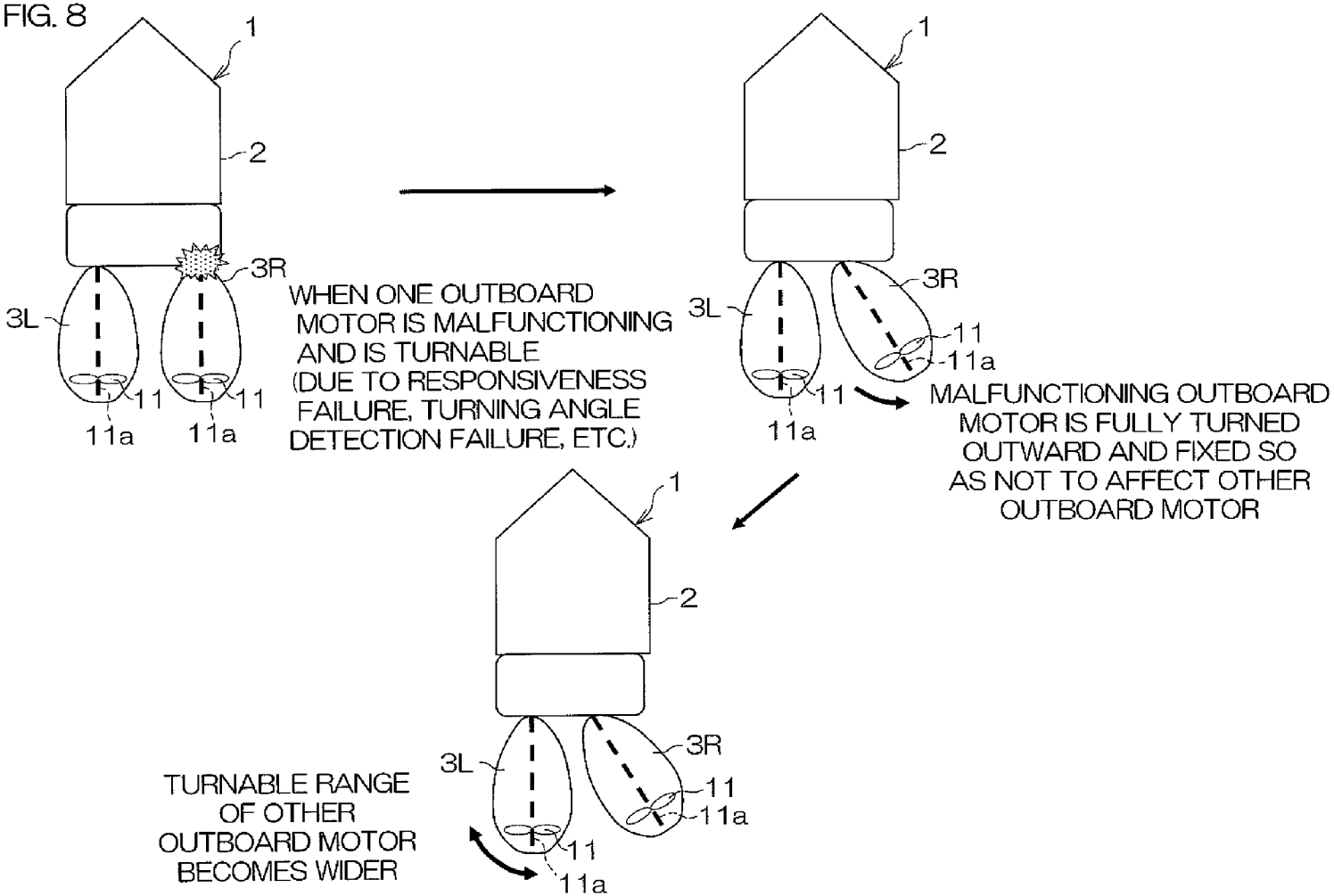
FIG. 8 is an explanatory view illustrating operations when either of the outboard motors is malfunctioning in turning angle control.

FIG. 8 is an explanatory view illustrating operations when either of the outboard motors is malfunctioning in turning angle control. For example, when the starboard outboard motor 3R is malfunctioning in turning angle control, the controller 6 determines whether the starboard outboard motor 3R is turnable. If it is not turnable, turning angle control of the starboard outboard motor 3R is stopped. When it is turnable, the controller 6 turns the starboard outboard motor 3R to the maximum right turning angle δRmax_r and then stops turning angle control. In other words, the maximum right turning angle δRmax_r is a non-interference turning angle of the starboard outboard motor 3R. Similarly, for the portside outboard motor 3L, the maximum left turning angle δLmax_l is a non-interference turning angle.

After thus stopping the turning angle control of the starboard outboard motor 3R, the controller 6 limits the turning angle range of the portside outboard motor 3L according to the turning angle δR of the starboard outboard motor 3R. The controller 6 performs turning angle control of the portside outboard motor 3L in the limited turning angle range.

Malfunction in turning angle control generally means that the turning angle of the outboard motor does not change with predetermined responsiveness in response to a command issued by the controller 6. In detail, assumed malfunctions include a case in which the turning resistance by the turning mechanism 4 increases (responding failure), a case in which the signal line of the turning angle sensor 30 is disconnected or short-circuited (turning angle detection failure), and a case in which a command signal line from the controller 6 is disconnected or short-circuited. Such malfunctions in turning angle control are classified into a case in which the outboard motor is not turnable and a case in which the outboard motor is turnable although the outboard motor has a problem with responsiveness, etc.

A malfunction in turning angle control is detected by monitoring a response of a turning angle to a turning command in the controller 6 (function as the malfunction determination unit 34). In detail, the controller 6 generates a target turning angle for the outboard motor 3, and detects a turning angle detected by the turning angle sensor 30. Then, when the turning angle does not reach the target turning angle even after elapse of a predetermined determination time from generation of the target turning angle, the controller 6 determines that turning angle control is malfunctioning.

Referring to FIG. 7 again, limitation on the turning angle range when the outboard motor is malfunctioning in turning angle control will be described. For example, a case in which the turning angle control of the starboard outboard motor 3R is malfunctioning and the turning angle control is stopped at a malfunctioning turning angle $\delta R_f$ is assumed. In this case, the portside target turning angle δL* is set according to the characteristic line 51 with respect to the basic target turning angle δ* not less than a basic target turning angle $\delta_{f1}$ corresponding to the malfunctioning turning angle $\delta R_f$. In other words, the portside target turning angle $\delta L_1$ corresponding to the malfunctioning turning angle $\delta R_f$ is defined as a new maximum right turning angle δLmax_r for the portside outboard motor 3L. Thus, the settable range of the portside target turning angle δL*, that is, the turning angle range of the portside outboard motor 3L is limited to the range 52 which does not cause interference with the starboard outboard motor 3R, the turning angle control of which is being stopped.

When the starboard outboard motor 3R malfunctioning in turning angle control is turnable and is turned to the maximum right turning angle δRmax_r, the limitation on the turning angle range of the portside outboard motor 3L is eventually the same as in the case in which turning angle control of the starboard outboard motor 3R is normal.

Next, a case in which turning angle control of the portside outboard motor 3L is malfunctioning and the turning angle control is stopped at a malfunctioning turning angle $\delta L_f$ is assumed. In this case, the starboard target turning angle δR* is set according to the characteristic line 53 with respect to the basic target turning angle δ* not more than a basic target turning angle $\delta f_2$ corresponding to the malfunctioning turning angle $\delta L_f$. In other words, the starboard target turning angle $\delta R_2$ corresponding to the malfunctioning turning angle $\delta L_f$ is defined as a new maximum left turning angle δRmax_l for the starboard outboard motor 3R. Thus, the settable range of the starboard target turning angle δR*, that is, the turning angle range of the starboard outboard motor 3R is limited to the range 54 which does not cause interference with the portside outboard motor 3L, the turning angle control of which is being stopped.

When the portside outboard motor 3L malfunctioning in turning angle control is turnable and is turned to the maximum left turning angle δLmax_l, limitation on the turning angle range of the starboard outboard motor 3R is eventually the same as in the case in which the turning angle control of the portside outboard motor 3L is normal.

Figure 9:
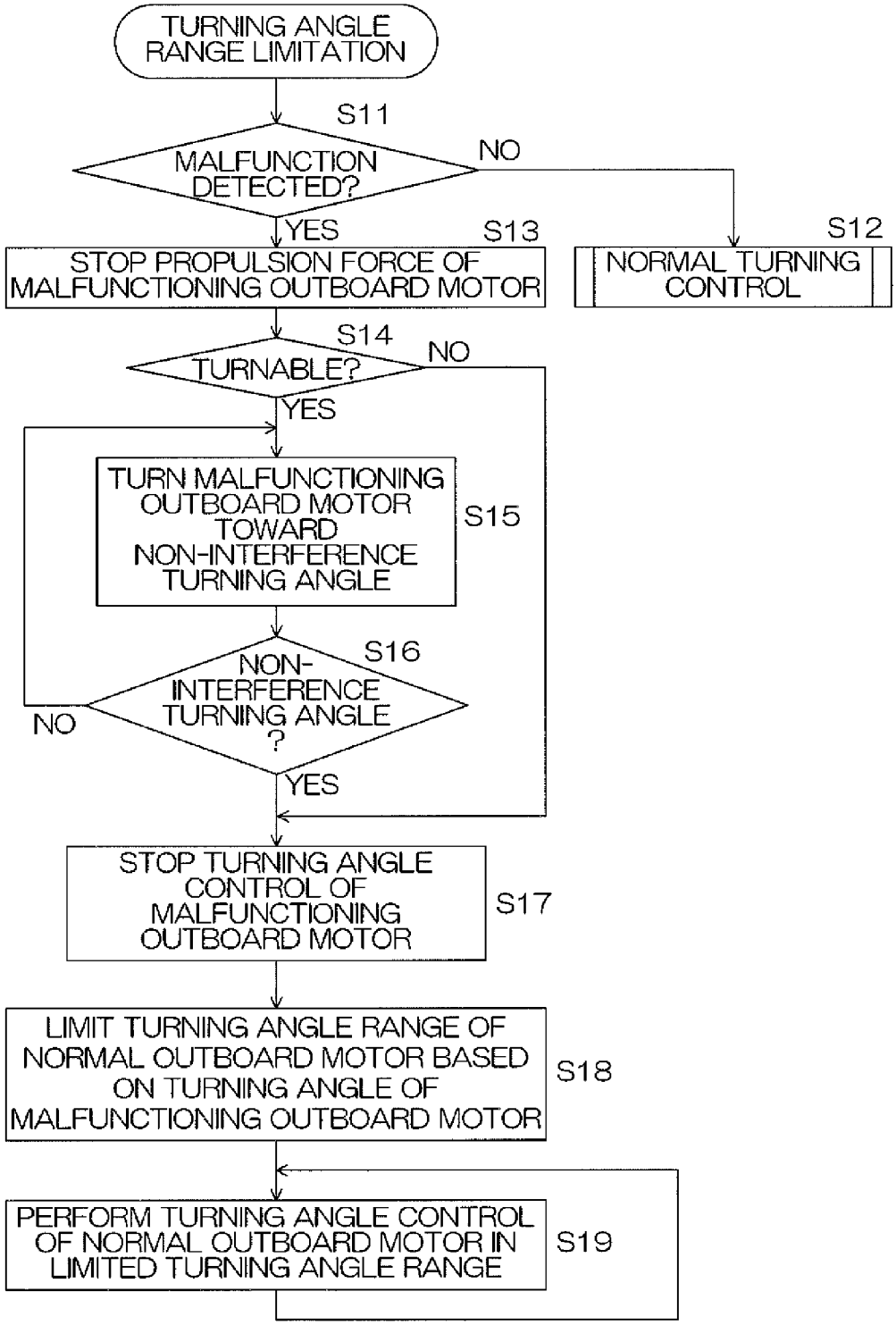
FIG. 9 is a flowchart for describing an operation example when the outboard motor is malfunctioning in turning angle control.

FIG. 9 is a flowchart for describing an operation example when the outboard motor is malfunctioning in turning angle control. The controller 6 determines whether either of the outboard motors 3L and 3R is malfunctioning in turning angle control (Step S11: function as the malfunction determination unit 34). When both outboard motors are normal in turning angle control (Step S11: NO), normal turning controls (see FIG. 6) are performed (Step S12). When either of the outboard motors is malfunctioning in turning angle control (Step S11: YES), the controller 6 stops propulsion force generation of the malfunctioning outboard motor (Step S13: function as the propulsion force control unit 39). In detail, the controller 6 sets the shift position of the malfunctioning outboard motor to the neutral position so as not to give a driving force of the engine 10 to the propeller 11. Accordingly, propulsion force generation can be stopped.

Next, the controller 6 determines whether the malfunctioning outboard motor is turnable (Step S14: function as the turnability determination unit 38). This determination can be performed by monitoring, for example, whether the turning angle detected by the turning angle sensor 30 changes when a drive current is supplied to the turning motor 24. If the malfunctioning outboard motor is turnable, the controller 6 drives the corresponding turning motor 24 to turn the malfunctioning outboard motor to a non-interference turning angle (Step S15: function as the non-interference control unit 37). When the malfunctioning outboard motor is the starboard outboard motor 3R, the non-interference turning angle is the maximum right turning angle δRmax_r. Also, when the malfunctioning outboard motor is the portside outboard motor 3L, the non-interference turning angle is the maximum left turning angle δLmax_l.

Further, the controller 6 monitors an output of the turning angle sensor 30 corresponding to the malfunctioning outboard motor, and determines whether the turning angle has reached the non-interference turning angle (Step S16). When the turning angle reaches the non-interference turning angle (Step S16: YES), the controller 6 stops turning angle control of the malfunctioning outboard motor (Step S17: function as the turning angle control stop unit 35). When the malfunctioning outboard motor is not turnable (Step S14: NO), the controller 6 immediately stops the turning angle control of the malfunctioning outboard motor (Step S17).

After stopping the turning angle control of the malfunctioning outboard motor, the controller 6 acquires a turning angle of the malfunctioning outboard motor at this timing from the corresponding turning angle sensor 30. Based on this turning angle, the controller 6 limits the turning angle range of the normally functioning outboard motor (Step S18: function as the turning angle range limitation unit 36). In detail, based on the turning angle of the malfunctioning outboard motor, a new maximum turning angle of the normally functioning outboard motor(s) is set. Thereafter, the controller 6 performs the turning angle control of only the normally functioning outboard motor(s) in the limited turning angle range (Step S19: function as the individual turning control unit 32).

Figure 10:
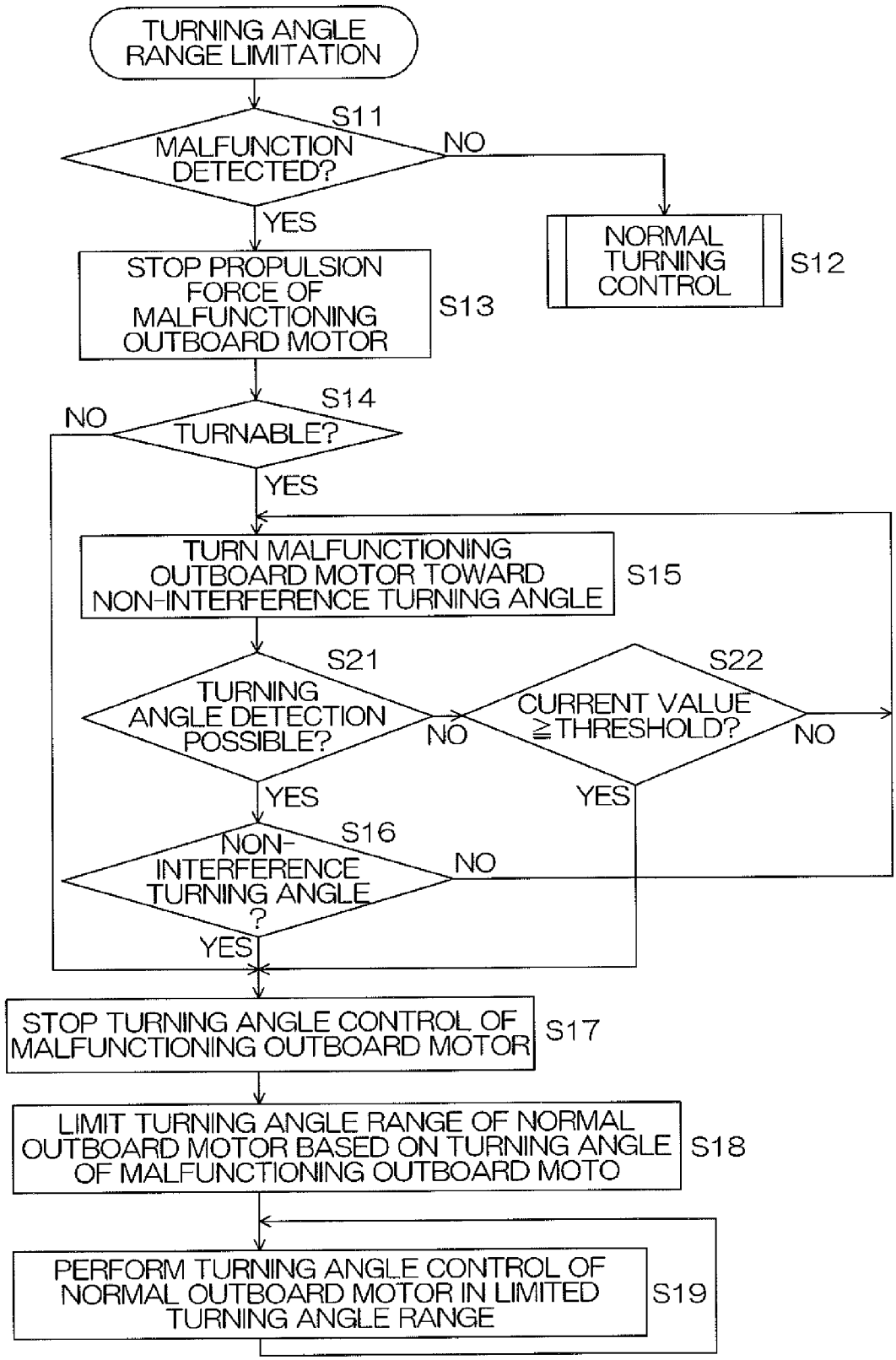
FIG. 10 is a flowchart for describing another operation example when the outboard motor is malfunctioning in turning angle control.

FIG. 10 is a flowchart for describing another operation example when the outboard motor is malfunctioning in turning angle control. In this FIG. 10, steps corresponding to the steps shown in FIG. 9 described above will be designated with the same reference symbols.

In this operation example, output signals of current detectors 41L and 41R (these are collectively referred to as "current detectors 41") which are arranged to detect drive currents of the turning motors 24L and 24R, respectively, are used (see FIG. 3).

In this operation example, the controller 6 determines whether detection of the turning angle is possible (Step S21). For example, when the signal line of the turning angle sensor 30 is disconnected or short-circuited, detection of the turning angle is impossible. When detection of the turning angle is possible (Step S21: YES), substantially the same operation as in FIG. 9 is performed. On the other hand, when detection of the turning angle is not possible (Step S21: NO), the controller 6 determines whether a drive current value of the turning motor 24 corresponding to the malfunctioning outboard motor is not less than a predetermined threshold with reference to the output signals of the current detector 41 (Step S22). When the malfunctioning outboard motor reaches the non-interference turning angle and turning thereof is physically limited, the load on the turning motor 24 increases, so that the drive current becomes higher. Therefore, the controller 6 controls turning of the malfunctioning outboard motor toward the non-interference turning angle (Step S15: function as the non-interference control unit 37) until the drive current value of the turning motor 24 becomes not less than the threshold (Step S22: YES). Therefore, even when detection of the turning angle is not possible, the malfunctioning outboard motor can be turned to the non-interference turning angle. Thereafter, the controller 6 stops turning control of the malfunctioning outboard motor and performs substantially the same processing as in the case of the operation example of FIG. 9.

Thus, according to the present preferred embodiment, when either of the portside outboard motor 3L and the starboard outboard motor 3R is malfunctioning in turning angle control, turning angle control of the malfunctioning outboard motor is stopped. Then, according to a turning angle of the malfunctioning outboard motor at the timing at which the turning angle control is stopped, the turning angle range of the normally functioning outboard motor is limited. By performing turning angle control of the normally functioning outboard motor in this limited turning angle range, the normally functioning outboard motor can be turned without interference from or with the malfunctioning outboard motor. As a result, turning performance of the marine vessel 1 can be secured while a predetermined or higher running speed is secured by effectively using the propulsion force of the normally functioning outboard motor. Further, when the malfunctioning outboard motor is turnable, the outboard motor is turned and moved to the non-interference turning angle, so that the turning angle range of the normally functioning outboard motor can be secured maximally.

Figure 11:
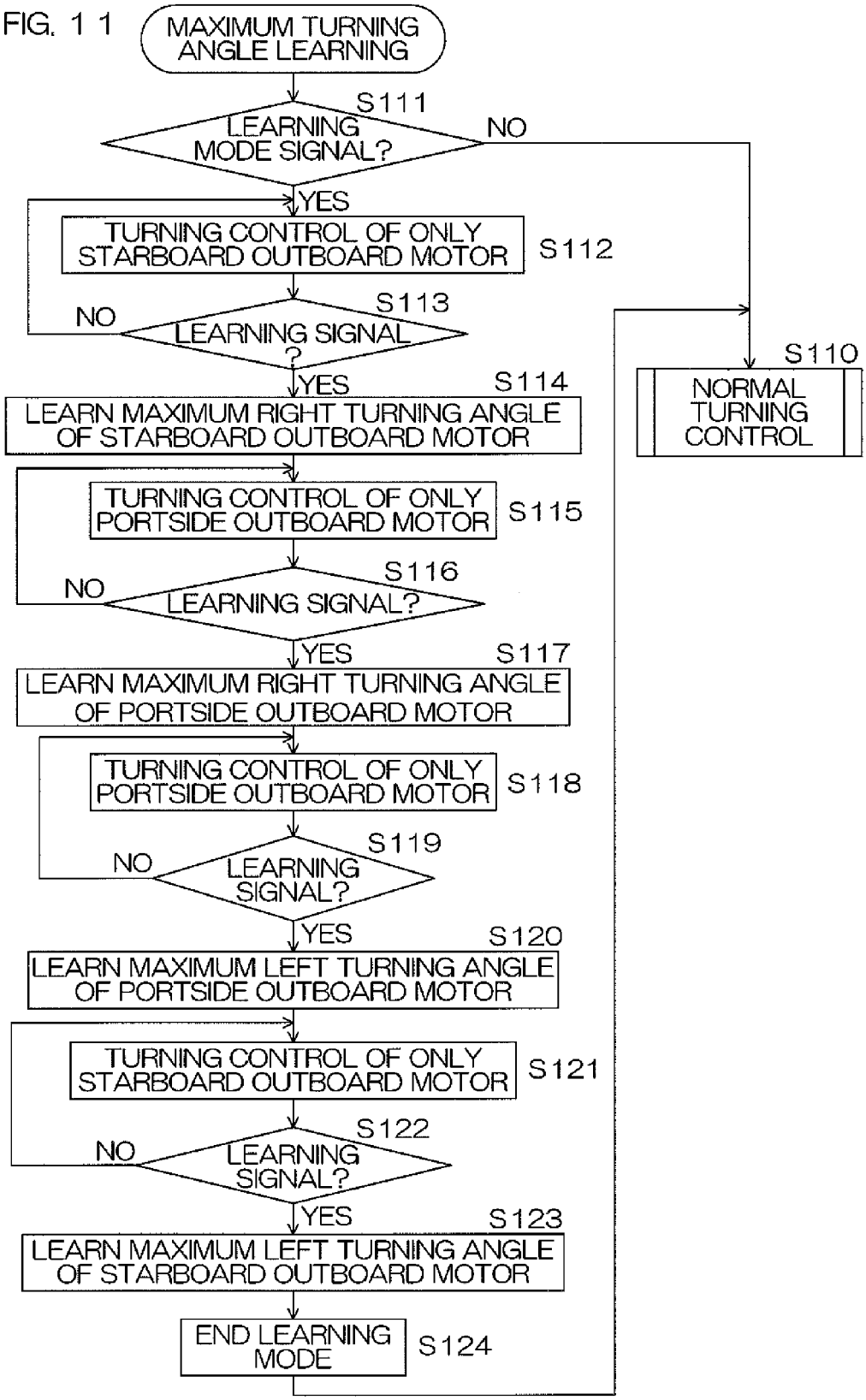
FIG. 11 is a flowchart for describing learning processing for setting a maximum right turning angle and a maximum left turning angle.

FIG. 11 is a flowchart for describing learning processing (function as the maximum turning angle acquisition unit 46) for setting a maximum right turning angle and a maximum left turning angle. By giving a predetermined learning mode signal to the controller 6, the controller 6 performs an operation according to a learning mode. The learning mode signal may be allowed to be input into the controller 6 by using, for example, an exclusive setting device connectable to the controller 6. The setting device may be a computer in which a predetermined program is installed.

The controller 6 determines whether a learning mode signal has been input (Step S111), and when no learning mode signal is input, the controller performs normal turning control (Step S110). Normal turning control means the control operation described with reference to FIG. 6 above.

When a learning mode signal is input (Step S111: YES), the controller 6 performs turning control of only the starboard outboard motor 3R (Step S112). In other words, according to a steering angle detected by the steering angle sensor 5*b*, the controller 6 controls only the starboard turning mechanism 4R corresponding to the starboard outboard motor 3R. An adjustment operator rotates the steering handle 5*a* clockwise while visually confirming the turning state of the starboard outboard motor 3R to turn the starboard outboard motor 3R to a maximum right turn position at which a minimum clearance can be secured between the starboard outboard motor and the hull and other structural portions. In this state, the operator supplies a learning signal to the controller 6 from the setting device (Step S113). In response to this learning signal, the controller 6 acquires a starboard turning angle δR detected by the starboard turning angle sensor 30R. Then, this acquired starboard turning angle δR is stored in the memory 6M as a maximum right turning angle δRmax_r for the starboard outboard motor 3R. Thus, the maximum right turning angle δRmax_r for the starboard outboard motor 3R is learned (Step S114).

Next, the controller 6 changes into a state in which the controller controls only the turning mechanism 4L for the portside outboard motor 3L (Step S115). Specifically, the controller 6 controls only the portside turning mechanism 4L according to the steering angle detected by the steering angle sensor 5*b*. The adjustment operator rotates the steering handle 5*a* clockwise while visually confirming the turning state of the portside outboard motor 3L to turn the portside outboard motor 3L to a maximum right turn position at which a minimum clearance can be secured between the portside outboard motor 3L and the starboard outboard motor 3R which has been turned to the maximum right turning angle. In this state, the operator supplies a learning signal to the controller 6 from the setting device (Step S116). In response to this learning signal, the controller 6 acquires a portside turning angle δL detected by the turning angle sensor 30L of the portside turning mechanism 4L. Then, the acquired portside turning angle δL is stored in the memory 6M as a maximum right turning angle δLmax_r for the portside outboard motor 3L. Thus, the maximum right turning angle δLmax_r for the portside outboard motor 3L is learned (Step S117).

Next, similar operations are performed for left turning of the outboard motors 3L and 3R.

The controller 6 performs turning control of only the portside outboard motor 3L (Step S118). Specifically, the controller 6 controls only the portside turning mechanism 4L according to the steering angle detected by the steering angle sensor 5*b*. The adjustment operator rotates the steering handle 5*a* counterclockwise while visually confirming the turning state of the portside outboard motor 3L to turn the portside outboard motor 3L to a maximum left turn position at which a minimum clearance can be secured between the portside outboard motor and the hull and other structural portions. In this state, the operator supplies a learning signal to the controller 6 from the setting device (Step S119). In response to this learning signal, the controller 6 acquires a portside turning angle δL detected by the turning angle sensor 30L of the portside turning mechanism 4L. Then, this acquired portside turning angle δL is stored in the memory 6M as a maximum left turning angle δLmax_l for the portside outboard motor 3L. Thus, the maximum left turning angle δLmax_l for the portside outboard motor 3L is learned (Step S120).

Next, the controller 6 turns into a state in which the controller controls only the turning mechanism 4R for the starboard outboard motor 3R (Step S121). Specifically, the controller 6 controls only the starboard turning mechanism 4R according to the steering angle detected by the steering angle sensor 5*b*. The adjustment operator rotates the steering handle 5*a* counterclockwise while visually confirming the turning state of the starboard outboard motor 3R to turn the starboard outboard motor 3R to a maximum left turn position at which a minimum clearance can be secured between the starboard outboard motor and the portside outboard motor 3L which has been turned to the maximum left turning angle. In this state, the operator supplies a learning signal to the controller 6 from the setting device (Step S122). In response to this learning signal, the controller 6 acquires a starboard turning angle δR detected by the turning angle sensor 30R of the starboard turning mechanism 4R. Then, this acquired starboard turning angle δR is stored in the memory 6M as a maximum left turning angle δRmax_l for the starboard outboard motor 3R. Thus, the maximum left turning angle δLmax_l for the starboard outboard motor 3R is learned (Step S123).

Thereafter, the learning mode is ended (Step S124), and the process switches to normal turning control (Step S110).

The left and right outboard motors 3L and 3R can be thus made to learn the maximum right turning angles and the maximum left turning angles. By using the learned maximum left and right turning angles, target turning angles δL* and δR* for the left and right outboard motors 3L and 3R are set according to an operation of the steering handle 5*a* (see FIG. 7).

Figure 12A:
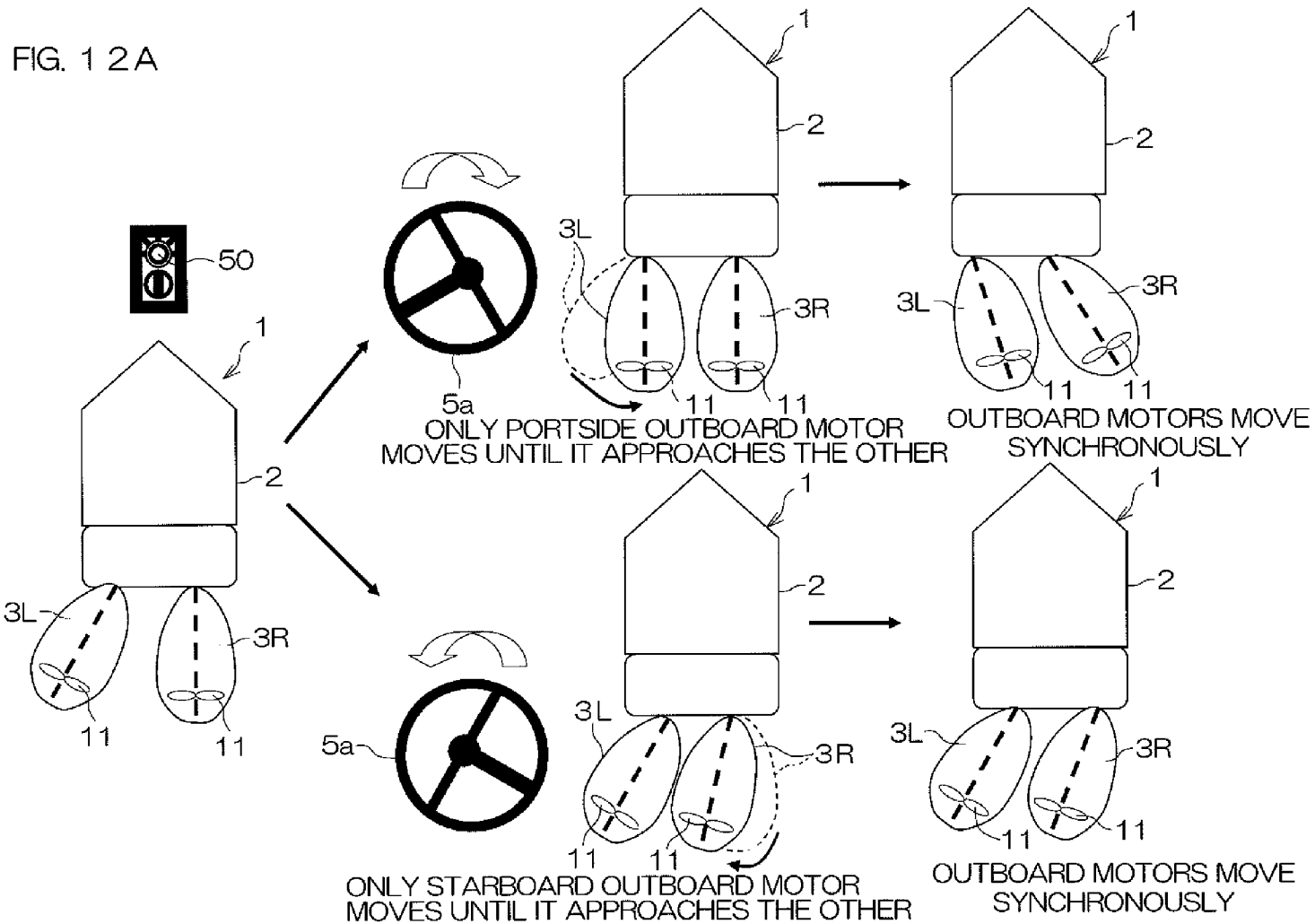
FIG. 12A is a view for describing an adjusting operation when a clearance between the outboard motors is larger than a proper value.
Figure 12B:
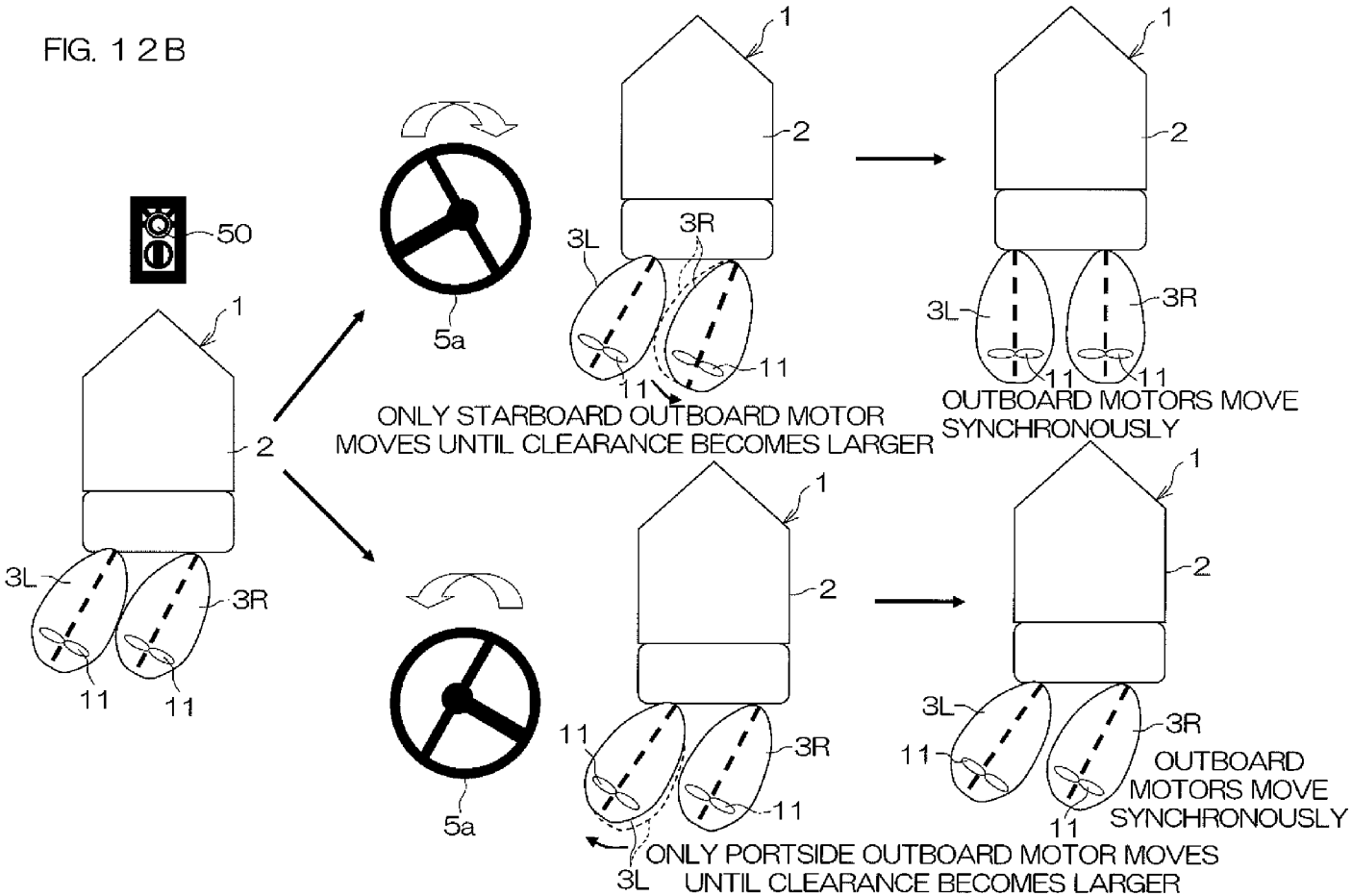
FIG. 12B is a view for describing an adjusting operation when the clearance between the outboard motors is smaller than the proper value.

FIG. 12A and FIG. 12B are explanatory views illustrating another characteristic operation in the present preferred embodiment. It is preferable that the turning angles δL and δR of the left ad right outboard motors 3L and 3R are kept as equal to each other as possible. Therefore, turning controls of the outboard motors 3L and 3R are performed so as to keep a proper clearance between the outboard motors 3L and 3R.

In detail, a case is assumed in which the clearance (difference between turning angles) between the outboard motors 3L and 3R is larger than the proper value, as shown in FIG. 12A, when the steering handle 5*a* is operated and the controller 6 starts the turning controls.

When the steering handle 5*a* is operated to rotate, a clearance adjustment operation is performed in response. In detail, when the steering handle 5*a* is operated clockwise, an operation of turning the portside outboard motor 3L to make it closer to the starboard motor 3R is performed without turning the starboard outboard motor 3R. Then, after the clearance becomes proper, both the outboard motors 3L and 3R are turned to the right synchronously.

On the other hand, when the steering handle 5*a* is operated counterclockwise, an operation of turning the starboard outboard motor 3R to make it closer to the portside outboard motor 3L is performed without turning the portside outboard motor 3L. Then, after the clearance becomes proper, both the outboard motors 3L and 3R are turned to the left synchronously.

Thus, when the clearance is excessively large, by turning the outboard motor on the upstream side with respect to the outboard motor movement direction (turning direction) corresponding to the steering direction of the steering handle 5*a* to make it closer to the outboard motor on the downstream side, the clearance between the outboard motors is adjusted.

Next, a clearance adjustment operation in the case in which the clearance between the outboard motors 3L and 3R is smaller than the proper value as shown in FIG. 12B when starting the controller 6 will be described.

When the steering handle 5*a* is operated to rotate, a clearance adjustment operation is performed in response. In detail, when the steering handle 5*a* is operated clockwise, an operation of clockwise turning the starboard outboard motor 3R to the right away from the portside outboard motor 3L without turning the portside outboard motor 3L, is performed. Then, after the clearance becomes proper, both the outboard motors 3L and 3R are turned synchronously to the right.

On the other hand, when the steering handle 5*a* is operated counterclockwise, an operation of turning the portside outboard motor 3L to the left away from the starboard outboard motor 3R is performed without turning the starboard outboard motor 3R. Then, after the clearance becomes proper, both the outboard motors 3L and 3R are turned synchronously to the left.

Thus, when the clearance is excessively small, the outboard motor on the downstream side with respect to the outboard motor movement direction (turning direction) corresponding to the steering direction of the steering handle 5*a* is turned away from the outboard motor on the upstream side. Accordingly, the clearance between the outboard motors is adjusted to a proper value.

Therefore, in the clearance adjustment operation, only the outboard motor which can make the clearance proper by turning in a direction corresponding to the steering direction of the steering handle 5*a* is turned in this direction.

When turning control of only one outboard motor is performed for clearance adjustment, for example, an indicator lamp 50 disposed on a steering seat may be actuated (for example, turned on or flashed) to notify the operator that the clearance adjustment is being performed. Of course, the operator may be notified of this by another notifying unit such as a buzzer.

Figure 13:
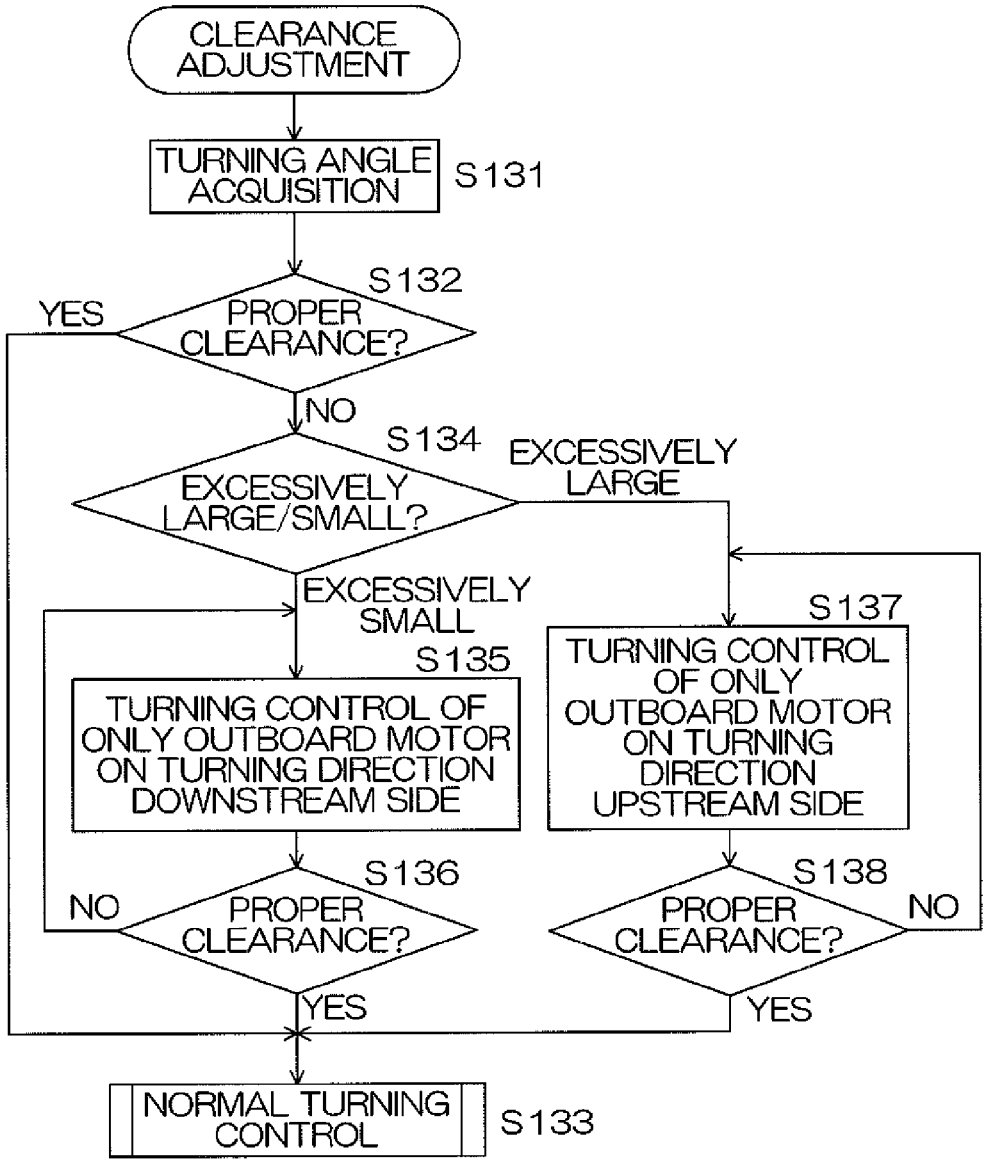
FIG. 13 is a flowchart for describing a clearance adjusting operation.

FIG. 13 is a flowchart for describing the clearance adjustment operation described above (function as the clearance adjustment unit 45). When the steering handle 5*a* is operated, the controller 6 acquires turning angles δL and δR of the left and right outboard motors 3L and 3R from the turning angle sensors 30L and 30R provided in the left and right turning mechanisms 4L and 4R (Step S131). The controller 6 determines whether the difference between the acquired turning angles δL and δR corresponds to the characteristic of the target turning angles (see FIG. 7), that is, whether a proper clearance is secured between the outboard motors 3L and 3R (Step S132) is determined. When the clearance is proper (Step S132: YES), the operation of the controller 6 switches to normal turning control (see FIG. 6) (Step S133).

When the clearance is improper (Step S132: NO), the controller 6 further determines whether the clearance is excessively large or small by comparing it with the proper value (Step S134).

When the clearance is excessively small, the controller 6 turns, toward the turning direction corresponding to the operating direction of the steering handle 5*a*, the outboard motor on the downstream side with respect to the turning direction (Step S135). This operation is continued until the clearance between the left and right outboard motors 3L and 3R calculated based on the turning angles δL and δR becomes proper (Step S136).

When the clearance is excessively large, the controller 6 turns, toward the turning direction corresponding to the operating direction of the steering handle 5*a*, the outboard motor on the upstream side with respect to the turning direction (Step S137). This operation is continued until the clearance between the left and right outboard motors 3L and 3R calculated based on the turning angles δL and δR becomes proper (Step S138).

When the clearance between the left and right outboard motors 3L and 3R becomes proper, the operation of the controller 6 switches to normal turning control (Step S133).

The outboard motor preferably has a streamline (drop-shaped) external shape in a plan view. In detail, the outboard motor preferably has a shape which becomes wider as it goes to the rear side from the turning central axis in a plan view. Therefore, as the turning angles from a turning angle neutral position become larger, the clearance between outboard motors adjacent to each other becomes smaller. Therefore, in a case of a multiple-outboard motor equipped arrangement including a plurality of outboard motors attached to a limited transom width, the turning angles are limited to ranges which do not cause the outboard motors adjacent to each other to interfere with each other. Therefore, as compared with a single-outboard motor equipped arrangement including only one outboard motor attached to the hull, the maximum turning angles become smaller. As a result, when the heading direction of the marine vessel must be greatly changed as in the case of launching from and docking on shore, the turning angles are limited.

In the present preferred embodiment, the individual turning angle setting unit 31 preferably individually sets target turning angles of the plurality of outboard motors such that the outboard motor on the more downstream side with respect to the turning direction has a larger turning angle. Then, the individual turning control unit 32 controls turning angles of the plurality of outboard motors according to target turning angles. With this arrangement, the target turning angles of the plurality of outboard motors are individually set such that the outboard motor on the more downstream side has a larger turning angle. Accordingly, the outboard motor disposed on the extreme downstream side with respect to the turning direction can be turned to a mechanical limit, and other outboard motors can also be turned to maximum turning angles in ranges which do not cause interference with the adjacent outboard motors. Thus, while avoiding interference between outboard motors, the outboard motors can be turned to the respective limits, so that the turning performance of the marine vessel can be improved.

The turning direction is a movement direction of the outboard motor when the outboard motor is turned with respect to the hull. In this case, the turning angle becomes larger as it becomes more distant from the center of the whole turning angle range. When a negative sign is assigned to a turning angle in one direction (for example, leftward direction), and a positive sign is assigned to a turning angle in the other direction (for example, rightward direction), the magnitude of the turning angle is represented by an absolute value.

In the present preferred embodiment, the individual turning control unit 32 performs turning angle control of the outboard motors so as to turn the plurality of outboard motors synchronously while preventing interference between the outboard motors adjacent to each other (while clearances are secured between the outboard motors).

Also, the present preferred embodiment includes a turning angle sensor 30 arranged to detect a turning angle of each outboard motor, and a maximum turning angle acquisition unit 46 arranged to acquire a turning angle of each outboard motor detected by the turning angle sensor 30 when the plurality of outboard motors are set into maximum turning states as a maximum turning angle of each outboard motor. The individual turning angle setting unit 31 is arranged to set a target turning angle of each outboard motor in a range not more than the corresponding maximum turning angle. With this arrangement, in the state in which the plurality of outboard motors are turned maximally, maximum turning angles of the outboard motors are acquired. In detail, the outboard motor (first outboard motor) on the extreme downstream side with respect to the turning direction is turned in one direction to a limit, and in this state, a turning angle of the first outboard motor is detected, and this detected value is defined as a maximum turning angle of the first outboard motor. Further, the second outboard motor adjacent to the first outboard motor is turned in the one direction to a limit state in which a predetermined clearance is secured between the second outboard motor and the first outboard motor, and in this state, a turning angle of the second outboard motor is detected, and this detected value is defined as a maximum turning angle of the second outboard motor. When there is another outboard motor, a maximum turning angle of the outboard motor in the one direction is obtained in the same manner. Maximum turning angles in the other direction opposite to the one direction of the outboard motors can also be obtained in the same manner. Accordingly, maximum turning angles in both directions of the outboard motors are obtained. The individual turning angle setting unit 31 sets target turning angles of the outboard motors in ranges not more than the maximum turning angles thus obtained.

Accordingly, regardless of mechanical errors of the individual turning devices and errors of the turning angle sensors 30, each outboard motor can be turned maximally. Depending on the stern shape, when the outboard motor is turned to the maximum, the outboard motor may come into contact with the hull. Even in this case, by acquiring a position at which the outboard motor does not come into contact with the hull as a maximum turning angle, a steering operator can operate the marine vessel without being concerned about interference between the outboard motors and the hull.

Further, this preferred embodiment includes a clearance adjustment unit 45 arranged to adjust the clearance between the outboard motors adjacent to each other by controlling turning angles of the plurality of outboard motors based on turning angles of the outboard motors detected by the turning angle sensors 30. Accordingly, the clearance between the outboard motors adjacent to each other is adjusted, so that turning angles of the outboard motors can be set to optimum values in ranges which do not cause interference between the outboard motors.

For example, when synchronous turning control of the plurality of outboard motors should be performed, if the clearance between a pair of outboard motors adjacent to each other is larger than the proper value, the outboard motor on the upstream side with respect to the turning direction is turned first until the clearance becomes proper, and thereafter, synchronous turning control of the outboard motors is started. Also, when the clearance between the pair of outboard motors adjacent to each other is smaller than the proper value, the outboard motor on the downstream side with respect to the turning direction is turned first until the clearance becomes proper, and thereafter, synchronous turning control of both the outboard motors is started. In other words, the outboard motor on the side which can make the clearance proper by turning in the turning direction is turned first, and after the clearance becomes proper, synchronous turning control of both the outboard motors is started. The clearance between the outboard motors can be obtained from, for example, turning angles of the outboard motors.

Figure 14:
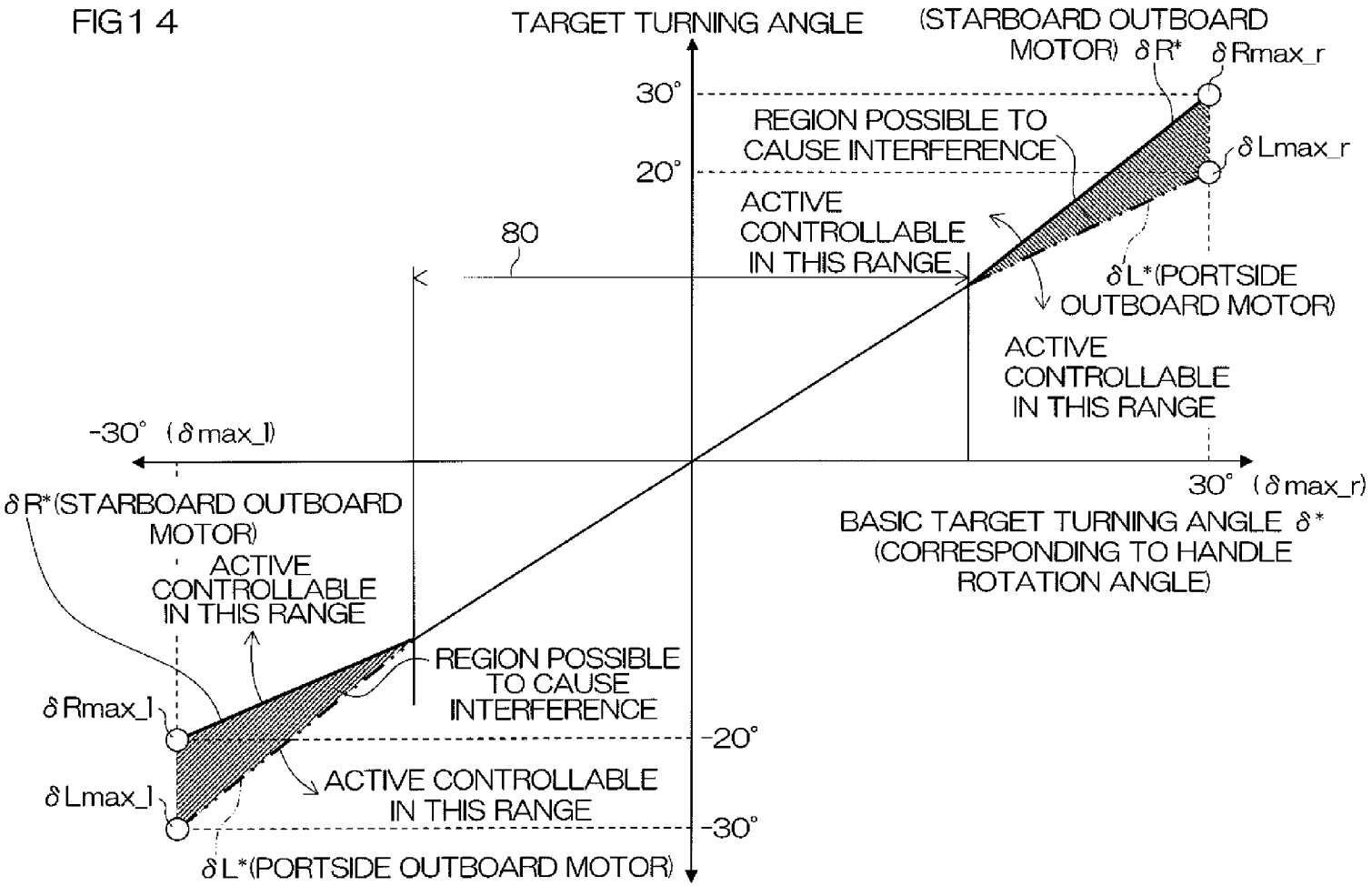
FIG. 14 is a view for describing another setting example of a portside target turning angle and a starboard target turning angle.

FIG. 14 is a view for describing another setting example of the portside target turning angle and the starboard target turning angle. In this setting example, a predetermined turning angle range around the turning angle neutral position (turning angle=0) is defined as an equal turning angle region 80. The equal turning angle region 80 is a region in which target turning angles δL* and δR* of the left and right outboard motors 3L and 3R are set to be equal to each other. This equal turning angle region 80 is a turning angle range in which while a clearance is held between the left and right outboard motors 3L and 3R, their propeller center line directions can be kept parallel to each other. In the equal turning angle region 80, both the portside target turning angle δL* and the starboard target turning angle δR* are set to be equal to the basic target turning angle δ*.

On the right side of the equal turning angle region 80, the portside target turning angle δL* and the starboard target turning angle δR* are determined so as to linearly change to the maximum right turning angles δLmax_r and δRmax_r. Similarly, on the left side of the equal turning angle region 80, the portside target turning angle δL* and the starboard target turning angle δR* are determined so as to linearly change to the maximum left turning angles δLmax_l and δRmax_l.

Figure 15:
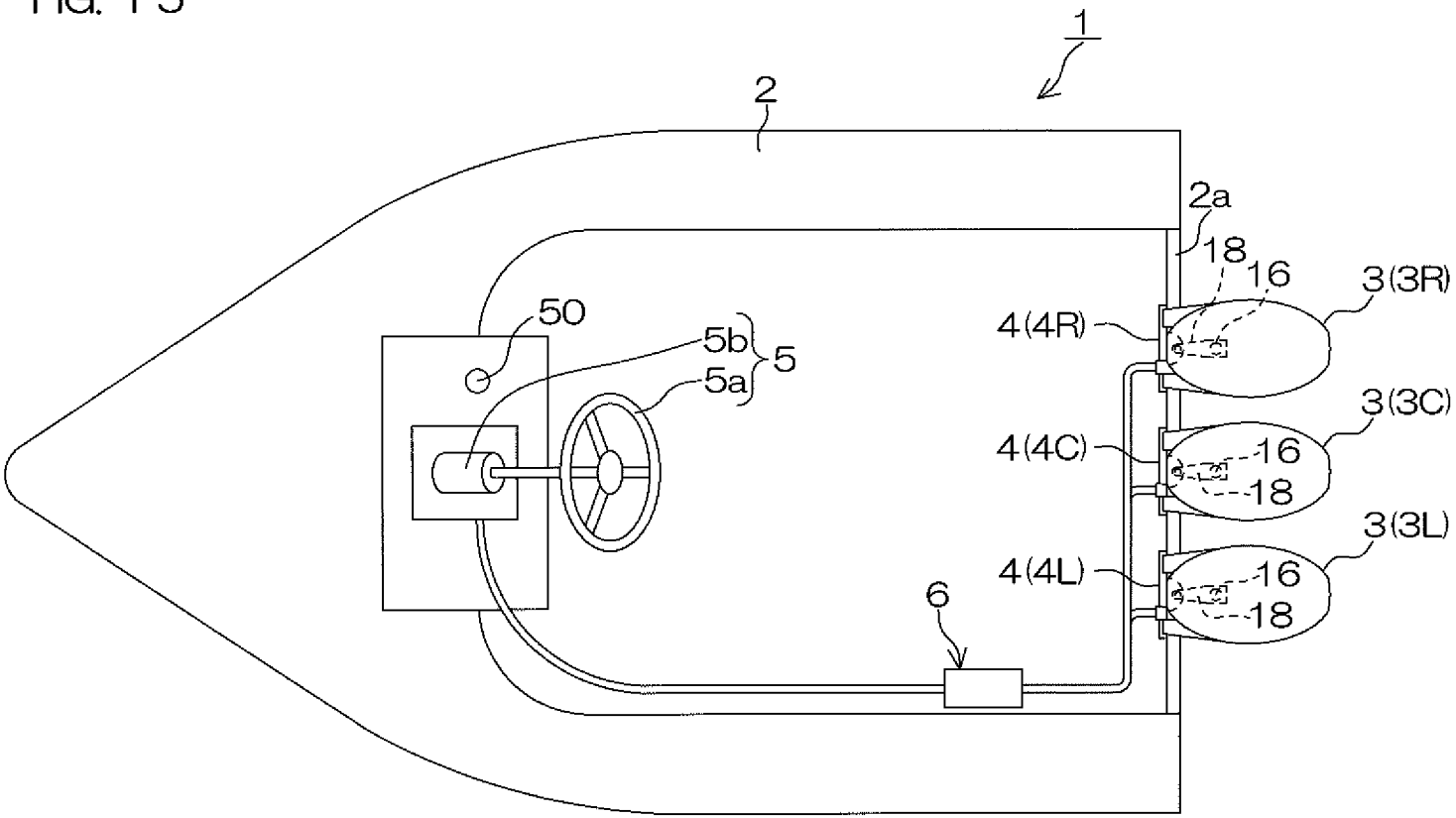
FIG. 15 is an illustrative plan view for describing an arrangement of a marine vessel of a second preferred embodiment of the present invention.

FIG. 15 is an illustrative plan view for describing an arrangement of a marine vessel relating to a second preferred embodiment of the present invention. In this FIG. 15, components corresponding to the components shown in FIG. 1 are designated with the same reference symbols.

The marine vessel of the present preferred embodiment is provided with another outboard motor 3C (hereinafter, referred to as "central outboard motor 3C" for distinction) between the left and right outboard motors 3L and 3R. The central outboard motor 3C is attached to the transom 2*a* of the hull 2 by substantially the same arrangement as the outboard motors 3L and 3R. Further, a central turning mechanism 4C is provided corresponding to the central outboard motor 3C. An arrangement of the central turning mechanism 4C is substantially the same as the portside turning mechanism 4L and the starboard turning mechanism 4R. A turning motor 24C (see FIG. 16) provided in the central turning mechanism 4C is arranged to be controlled by the controller 6.

Figure 16:
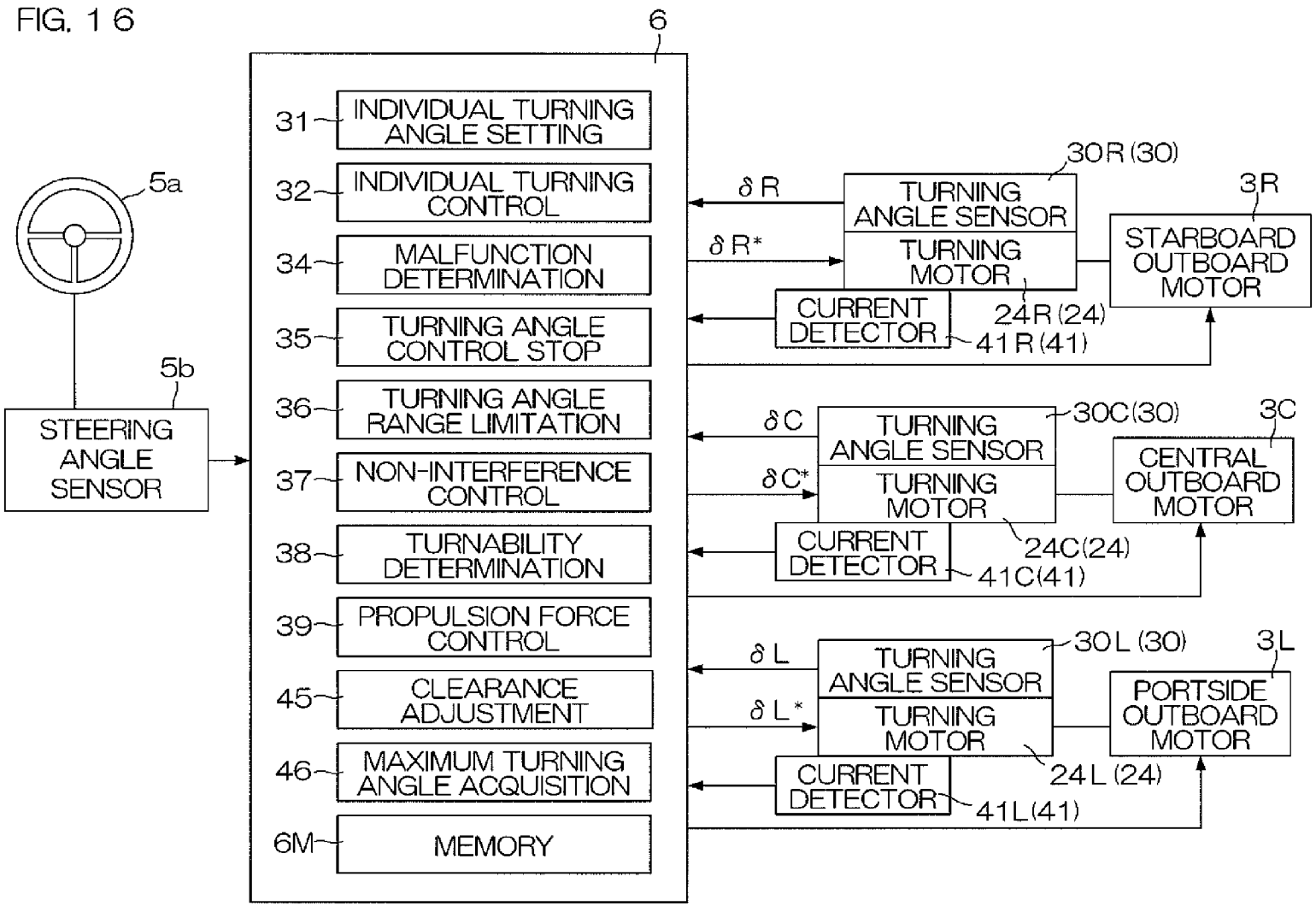
FIG. 16 is a block diagram showing an electric arrangement of the marine vessel of the second preferred embodiment of the present invention.

FIG. 16 is a block diagram showing an electric arrangement of a marine vessel according to the present preferred embodiment. In FIG. 16, components corresponding to the components shown in FIG. 3 described above are designated with the same reference symbols. In the present preferred embodiment, as a control object of the controller 6, the turning motor 24C is added. An output signal of a central turning angle sensor 30C arranged to detect a turning angle δC of the central outboard motor 3C is input into the controller 6. The controller 6 controls operations of the central turning motor 24C according to a steering angle detected by the steering angle sensor 5*b* and the turning angle (central turning angle)

detected by the central turning angle sensor 30C. Also, the controller 6 uses an output signal of a current detector 41C arranged to detect a drive current of the central turning motor 24C, as necessary.

Figure 17:
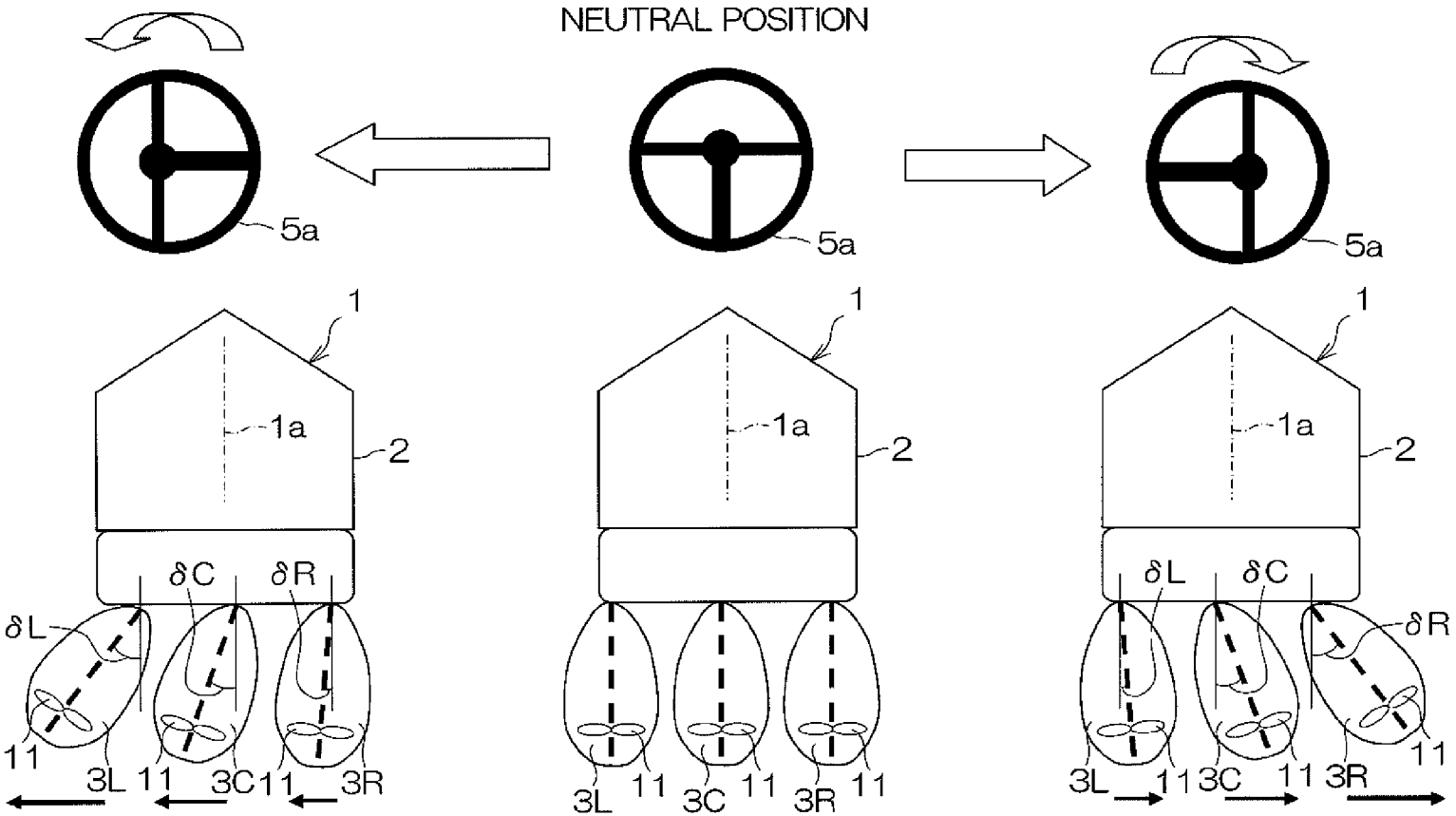
FIG. 17 is an explanatory view illustrating turning angle control of three outboard motors.

FIG. 17 is an explanatory view illustrating turning angle control of three outboard motors. When the steering handle 5*a* is at a neutral position, turning angles δL, δR, and δC of the left, right, and central outboard motors 3L, 3R, and 3C are zero. In other words, the three outboard motors 3L, 3R, and 3C generate propulsion forces in directions parallel or substantially parallel to each other.

When the steering handle 5*a* is operated to rotate clockwise, the turning angles δL, δR, and δC of the left, right, and central outboard motors 3L, 3R, and 3C change in response thereto, and the propellers 11 of the outboard motors 3L, 3R, and 3C are turned to the right with respect to the hull 2. Accordingly, propulsion forces of the outboard motors 3L, 3R, and 3C become leftward with respect to the marine vessel center line 1*a*. As a result, the marine vessel 1 is turned to the right. As the operation amount to rotate the steering handle 5*a* clockwise becomes larger, the turning angles δL, δR, and δC of the outboard motors 3L, 3R, and 3C also become larger. However, the turning angles δL, δR, and δC of the three outboard motors 3L, 3R, and 3C are not equal to each other. In detail, the starboard turning angle δR is larger than the central turning angle δC, and the central turning angle δC is larger than the portside turning angle δL. The difference between the turning angles δL and 6C and the difference between the turning angles δC and δR become larger as the turning angles δL, δR, and δC become larger. This is for avoiding interference between the outboard motors 3L, 3R, and 3C having external shapes which become wider as it goes to the rear side in a plan view. Specifically, if the turning angles δL, δR, and δC of the outboard motors 3L, 3R, and 3C are equal to each other, as the turning angles become larger, the clearances between the adjacent pairs of the outboard motors 3L, 3R, and 3C become smaller and finally cause the outboard motors to come into contact with each other. Therefore, in the present preferred embodiment, the turning angles are set such that the outboard motor positioned on the more downstream side (right side) with respect to the turning direction has a larger turning angle.

Steering to the left is also the same. Specifically, when the steering handle 5*a* is operated to rotate counterclockwise, the turning angles δL, δR, and δC of the right, left and central outboard motors 3L, 3R, and 3C change in response thereto, and the propellers 11 of the outboard motors 3L, 3R, and 3C are turned to the left with respect to the hull 2. Accordingly, propulsion forces of the outboard motors 3L, 3R, and 3C become rightward with respect to the marine vessel center line 1*a*. As a result, the marine vessel 1 is turned to the left. As the operation amount to rotate the steering handle 5*a* counterclockwise becomes larger, the turning angles δL, δR, and δC of the outboard motors 3L, 3R, and 3C also become larger. However, the portside turning angle δL is larger than the central turning angle δC, and the central turning angle δC is larger than the starboard turning angle δR. In other words, the turning angles are set such that the outboard motor on the more downstream side (left side) with respect to the turning direction has a larger turning angle. As the turning angles become larger, the difference between the turning angles δL and δC and the difference between the turning angles δC and δR become larger.

Figure 18:
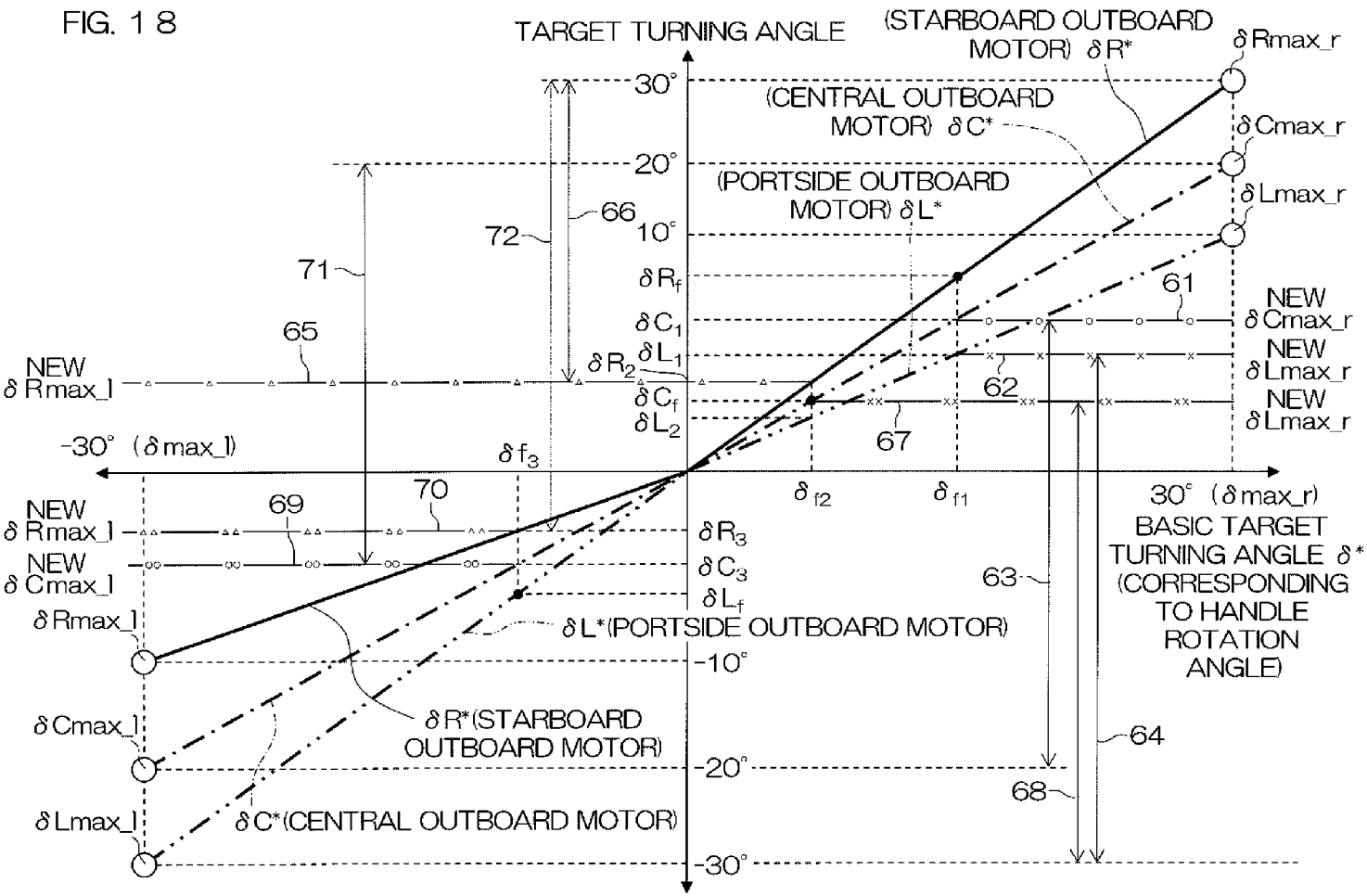
FIG. 18 is a view for describing a setting example of a portside target turning angle, a starboard target turning angle, and a central target turning angle.

FIG. 18 is a view for describing a setting example of the portside target turning angle, the starboard target turning angle, and the central target turning angle. As in the case of FIG. 7, the turning angles are expressed with a positive sign in the case of right turning and with a negative sign in the case of left turning. The horizontal axis indicates a basic target turning angle δ* which corresponds to (in proportion to) a steering angle of the steering handle 5*a*.

In a region in which the basic target turning angle δ* is positive (rightward steering region), the starboard target turning angle δR* is determined to be equal to the basic target turning angle δ*. On the other hand, the central target turning angle δC* is determined to be smaller than the basic target turning angle δ*, and the portside target turning angle δL* is determined to be smaller than the central target turning angle δC*. Similarly, in a region in which the basic target turning angle δ* is negative (leftward steering region), the portside target turning angle δL* is determined to be equal to the basic target turning angle δ*. On the other hand, the central target turning angle δC* is determined such that its absolute value is smaller than the absolute value of the basic target turning angle δ*. Further, the starboard target turning angle δR* is determined such that its absolute value is smaller than the absolute value of the central target turning angle δC*.

In detail, the starboard target turning angle δR*, the central target turning angle δC*, and the portside target turning angle δL* are determined so as to linearly change from zero to respective maximum right turning angles δRmax_r, δCmax_r, and δLmax_r when the basic target turning angle δ* changes from zero to a maximum right turning angle δmax_r (for example, 30 degrees). Also, the starboard target turning angle δR*, the central target turning angle δC*, and the portside target turning angle δL* are determined so as to linearly change from respective maximum left turning angles δRmax_l, δCmax_l, and δLmax_l to zero when the basic target turning angle δ* changes from a maximum left turning angle δmax_l (for example, −30 degrees) to zero. Then, the maximum right turning angles δRmax_r, δCmax_r, and δLmax_r satisfy the relationships of $\delta Rmax_r-\delta Cmax_r \geqq \epsilon_1$ ($\epsilon_1>0$) and $\delta Cmax_r-\delta Lmax_r \geqq \epsilon_2$ ($\epsilon_2>0$). Similarly, the maximum left turning angles δRmax_l, δCmax_l, and δLmax_l satisfy the relationships of $|\delta Lmax_l|-|\delta Cmax_l| \geqq_3$ ($\epsilon_3>0$) and $|\delta Cmax_l-|\delta Rmax_l| \geqq \epsilon_4$ ($\epsilon_4>0$). $\epsilon_1$, $\epsilon_2$, $\epsilon_3$, $\epsilon_4$ are values (minimum turning angle differences at maximum turning angles) obtained by converting, into turning angle differences, minimum clearances which should be secured between the adjacent pairs of the outboard motors 3L, 3R, and 3C in the maximum turning states in which the outboard motors are turned maximally to the right or the left.

Thus, in the right turning angle region, the target turning angles δC* and δL* of the central and the portside outboard motors 3C and 3L are set to be smaller than the basic target turning angle δ*. Also, in the left turning angle region, the target turning angles δC* and δR* of the central and starboard outboard motors 3C and 3R are set such that their absolute values are smaller than the absolute value of the basic target turning angle δ*. Accordingly, at any turning angle, interference between the outboard motors 3L and 3R can be avoided. Further, the outboard motor on the more downstream side with respect to the turning direction can secure a larger maximum turning angle, so that turning performance of the marine vessel can be improved.

Figure 19:
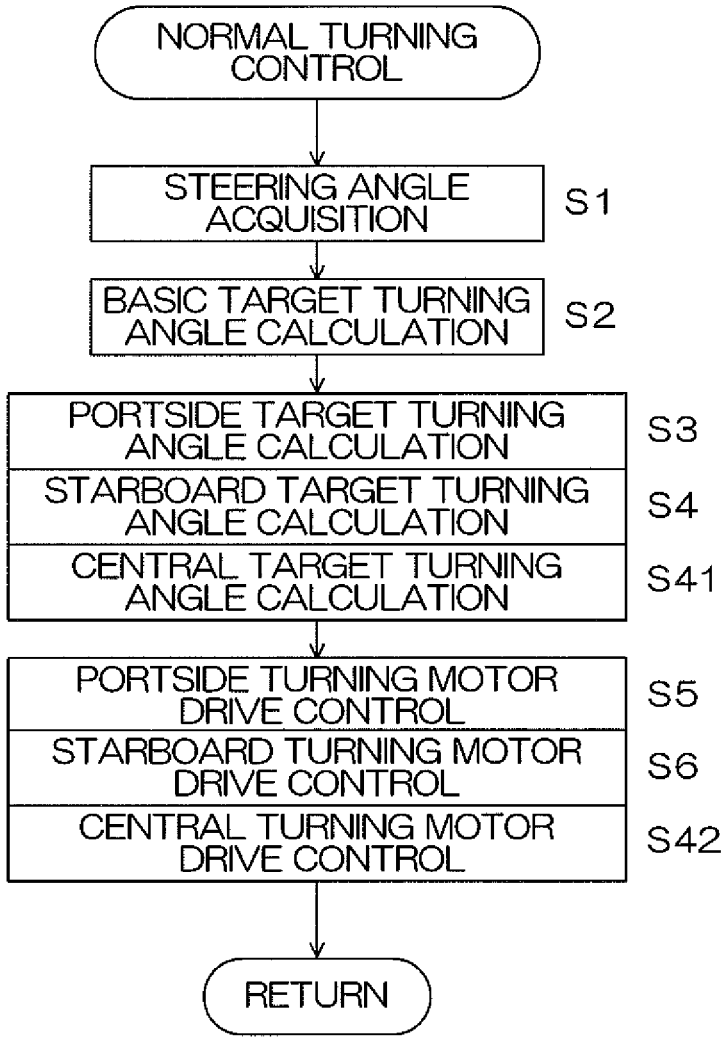
FIG. 19 is a flowchart for describing turning controls to be performed by a controller in the second preferred embodiment of the present invention.

FIG. 19 is a flowchart for describing turning controls to be performed by the controller 6. In this FIG. 19, steps corresponding to the steps shown in FIG. 6 described above are designated with the same reference symbols.

The controller 6 acquires a steering angle detected by the steering angle sensor 5*b* (Step S1), and calculates a basic target turning angle δ* corresponding to the steering angle (Step S2).

Next, the controller 6 obtains the portside target turning angle δL*, the starboard target turning angle δR* and the central target turning angle δC* based on the basic target turning angle δ* (Steps S3, S4, and S41: function as the individual turning angle setting unit 31).

When the target turning angles δL*, δR* and δC* of the outboard motors 3L, 3R, and 3C are thus obtained, the controller 6 respectively controls the turning motors 24L, 24R, and 24C of the portside turning mechanism 4L, the starboard turning mechanism 4R, and the central turning mechanism 4C based on these target turning angles δL*, δR*, and δC* (Steps S5, S6, and S42: function as the individual turning control unit 32). In detail, the controller 6 feed-back controls the turning motors 24L, 24R, and 24C so as to cause the actual turning angles δL, δR, and δC of the portside, starboard, and central outboard motors 3L, 3R, and 3C detected respectively by the turning angle sensors 30L, 30R and 30C to be equal to the respective target turning angles δL*, δR*, and δC*.

Figure 20:
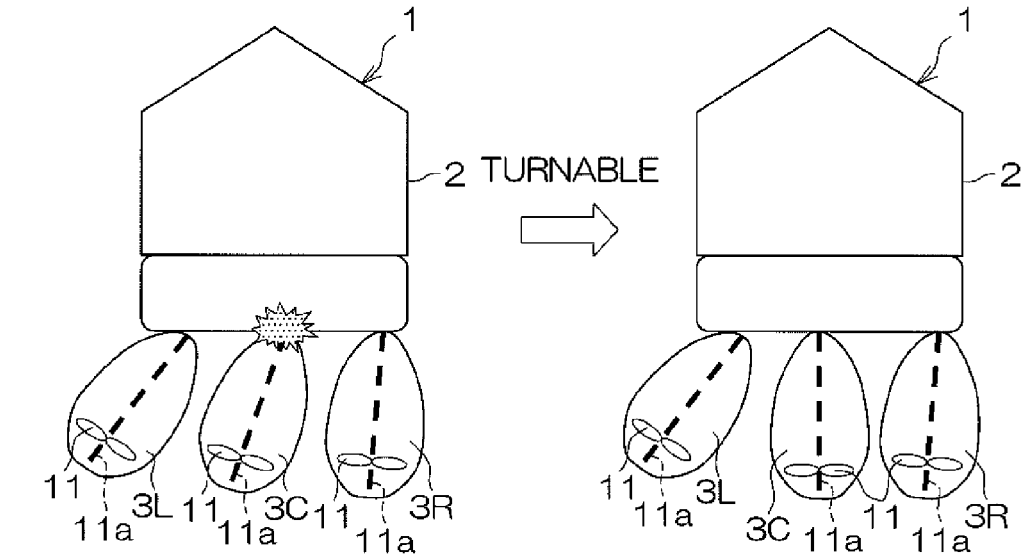
FIG. 20 is an explanatory view illustrating operations when the central outboard motor is malfunctioning in turning angle control.

FIG. 20 is an explanatory view illustrating operations when the central outboard motor is malfunctioning in turning angle control. Operations when the starboard outboard motor 3R or the portside outboard motor 3L is malfunctioning in turning angle control are substantially the same as in the case of the first preferred embodiment described above.

When the central outboard motor 3C is malfunctioning in turning angle control, the controller 6 determines whether the central outboard motor 3C is turnable. When it is not turnable, the controller stops the turning angle control of the central outboard motor 3C. When it is turnable, the controller 6 turns the central outboard motor 3C to a neutral position (δC=0), and then stops turning angle control concerning the central outboard motor 3C. Specifically, the center position of the turning angle range is a non-interference turning angle of the central outboard motor 3C.

After turning angle control of the central outboard motor 3C is thus stopped, the controller 6 limits the turning angle ranges of the starboard outboard motor 3R and the portside outboard motor 3L according to the turning angle δC of the central outboard motor 3C. The controller 6 performs turning angle control of the starboard outboard motor 3R and the portside outboard motor 3L in the respective ranges of the limited turning angles.

Referring to FIG. 18 again, limitations on the turning angle ranges when turning angle control of the outboard motor is malfunctioning will be described.

For example, a case in which the starboard outboard motor 3R is malfunctioning in turning angle control and the turning angle control is stopped at a malfunctioning turning angle $\delta R_f$ is assumed. At this time, with respect to the basic target turning angle δ* not less than the basic target turning angle $\delta_{f1}$ corresponding to the malfunctioning turning angle $\delta R_f$, the central target turning angle δC* is set according to the characteristic line 61, and the portside target turning angle δL* is set according to the characteristic line 62. In other words, the central turning angle $\delta C_1$ corresponding to the malfunctioning turning angle $\delta R_f$ is set as a new maximum right turning angle δCmax_r for the central outboard motor 3C. Also, the portside target turning angle $\delta L_1$ corresponding to the malfunctioning turning angle $\delta R_f$ is set as a new maximum right turning angle δLmax_r for the portside outboard motor 3L. Thus, the settable range of the central target turning angle δC*, that is, the turning angle range of the central outboard motor 3C is limited to a range 63 which does not cause interference with the starboard outboard motor 3R, the turning angle control of which is being stopped. Further, the settable range of the portside target turning angle δL*, that is, the turning angle range of the portside outboard motor 3L is limited to a range 64 which does not cause interference with the central outboard motor 3C that is turnable in the limited turning angle range 63.

When the starboard outboard motor 3R malfunctioning in turning angle control is turnable and is turned to the maximum right turning angle δRmax_r, the limitations on the turning angle ranges of the central outboard motor 3C and the portside outboard motor 3L are eventually the same as in the case in which turning angle control of the starboard outboard motor 3R is normal.

Next, a case in which the central outboard motor 3C is malfunctioning in turning angle control, and the turning angle control is stopped at a malfunctioning turning angle $\delta C_f$ will be assumed. In this case, with respect to the basic target turning angle δ* not more than the target turning angle $\delta_{f2}$ corresponding to the malfunctioning turning angle $\delta C_f$, the starboard target turning angle δR* is set according to the characteristic line 65. In other words, the starboard target turning angle $\delta R_2$ corresponding to the malfunctioning turning angle $\delta C_f$ is set as a new maximum left turning angle δRmax_l for the starboard outboard motor 3R. Thus, the settable range of the starboard target turning angle δR*, that is, the turning angle range of the starboard outboard motor 3R is limited to a range 66 which does not cause interference with the central outboard motor 3C, the turning angle control of which is being stopped. Also, with respect to the basic target turning angle δ* not less than the target turning angle $\delta_{f2}$ corresponding to the malfunctioning turning angle $\delta C_f$, the portside target turning angle δL* is set according to the characteristic line 67. In other words, the portside target turning angle $\delta L_2$ corresponding to the malfunctioning turning angle $\delta C_f$ is set as a new maximum right turning angle δLmax_r for the portside outboard motor 3L. Thus, the settable range of the portside target turning angle δL*, that is, the turning angle range of the portside outboard motor 3L is limited to the range 68 which does not cause interference with the central outboard motor 3C, the turning angle control of which is being stopped.

When the central outboard motor 3C malfunctioning in turning angle control is turnable and is turned to a neutral position as a non-interference turning angle (δc=0), the maximum left turning angle δRmax_l=0 is set for the starboard outboard motor 3R, and the maximum right turning angle δLmax_r=0 is set for the portside outboard motor 3L.

Next, a case in which the portside outboard motor 3L is malfunctioning in turning angle control and the turning angle control is stopped at a malfunctioning turning angle $\delta L_f$ is assumed. At this time, with respect to the basic target turning angle δ* not more than the target turning angle $\delta_{f3}$ corresponding to the malfunctioning turning angle $\delta L_f$, the central target turning angle δC* is set according to the characteristic line 69, and the starboard target turning angle δR* is set according to the characteristic line 70. In other words, the central target turning angle $\delta C_3$ corresponding to the malfunctioning turning angle $\delta L_f$ is set as a new maximum left turning angle δCmax_l for the central outboard motor 3C. Also, the starboard target turning angle $\delta R_3$ corresponding to the malfunctioning turning angle $\delta L_f$ is set as a new maximum left turning angle δRmax_l for the starboard outboard motor 3R. Thus, the settable range of the central target turning angle δC*, that is, the turning angle range of the central outboard motor 3C is limited to a range 71 which does not cause interference with the portside outboard motor 3L the turning angle control of which is being stopped. Also, the settable range of the starboard target turning angle δR*, that is, the turning angle range of the starboard outboard motor 3R is limited to a range 72 which does not cause interference with the central outboard motor 3C turned in the limited turning angle range 71.

When the portside outboard motor 3L malfunctioning in turning angle control is turnable and is turned to the maximum left turning angle δLmax_l, the limitations on the turning angle ranges of the central outboard motor 3C and the starboard outboard motor 3R are eventually the same as in the case in which turning angle control of the portside outboard motor 3L is normal.

Figure 21:
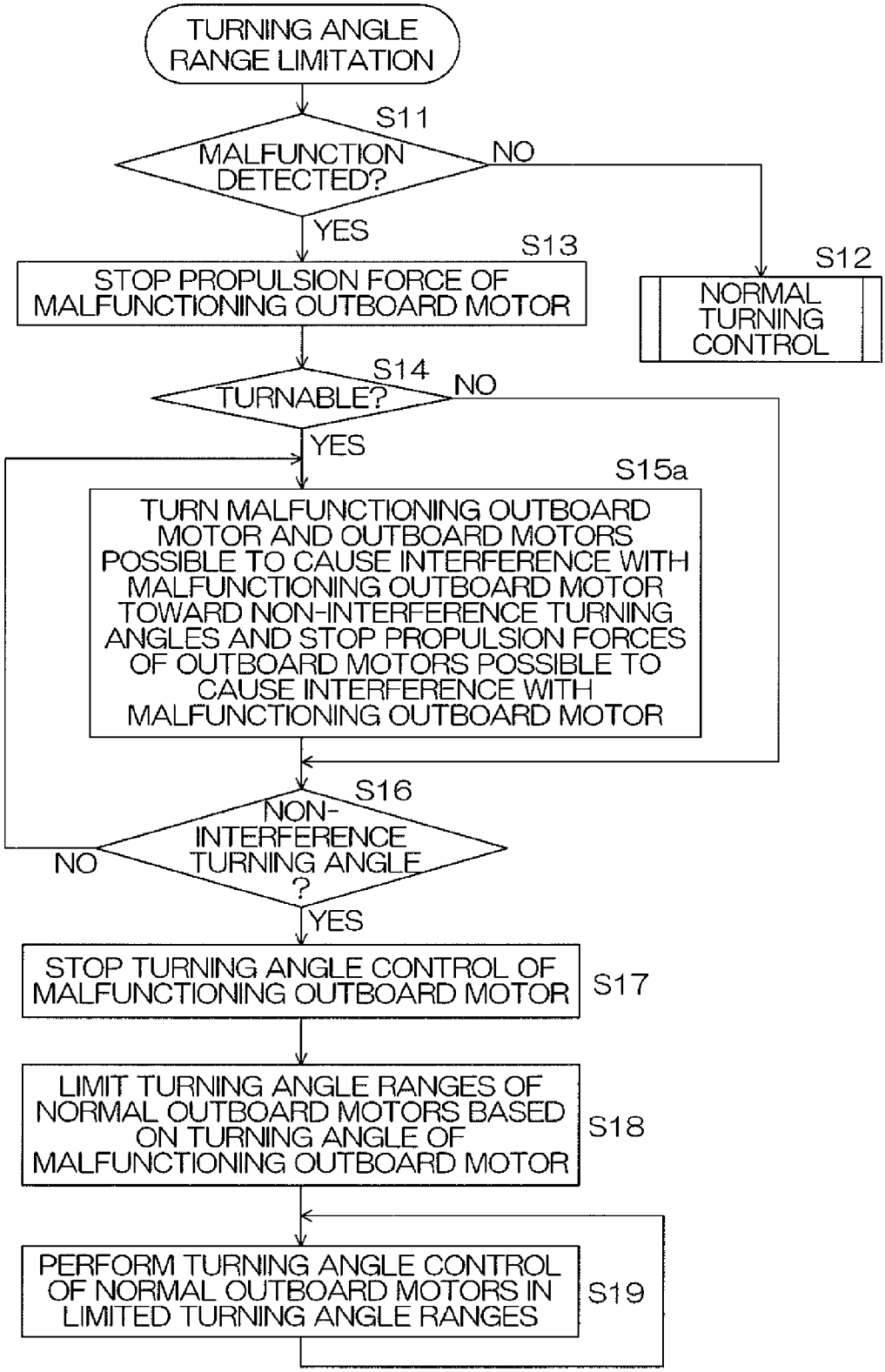
FIG. 21 is a flowchart for describing an operation example when the outboard motor is malfunctioning in turning angle control.

FIG. 21 is a flowchart for describing an operation example when the outboard motor is malfunctioning in turning angle control. In this FIG. 21, steps corresponding to the steps shown in FIG. 9 described above are designated with the same reference symbols. Operations when the portside outboard motor 3L or the starboard outboard motor 3R is malfunctioning in turning angle control are substantially the same as in the first preferred embodiment (see FIG. 9) described above. On the other hand, in the case in which the central outboard motor 3C is malfunctioning in turning angle control, when the central outboard motor is turned to the non-interference turning angle (neutral position), it may interfere with another outboard motor (the portside outboard motor 3L or the starboard outboard motor 3R). Therefore, when the central outboard motor 3C is malfunctioning in turning angle control, the outboard motor which may cause the interference with the central outboard motor must be turned simultaneously in the same direction.

Therefore, in the present preferred embodiment, when the central outboard motor 3C is malfunctioning in turning angle control and is turned to a non-interference turning angle, the controller 6 performs control for turning outboard motors which may interfere with the central outboard motor in the same direction (Step S15*a*). At this time, to prevent turning of the marine vessel 1 contrary to an operator's intention, the controller 6 stops propulsion force generation of not only the central outboard motor 3C but also force generation of the outboard motors which may interfere with the central outboard motor.

After the central outboard motor 3C is moved to the non-interference turning angle, the controller 6 restarts propulsion force generations of the outboard motors which may interfere with the central outboard motor, and performs turning angle control of the portside outboard motor 3L and the starboard outboard motor 3R. The turning angle ranges in this case are maximum ranges which do not cause interference with the central outboard motor 3C fixed at the non-interference turning angle. Of course, when the central outboard motor 3C is not turnable (Step S14), the controller 6 stops turning angle control of the central outboard motor 3C at the position as of the time (Step S17). Then, the controller 6 limits turning angle ranges for the portside outboard motor 3L and the starboard outboard motor 3R according to the turning angle of the central outboard motor 3C at the stop position (Step S18), and performs turning angle control of the outboard motors 3L and 3R in these limited turning angle ranges (Step S19).

Figure 22:
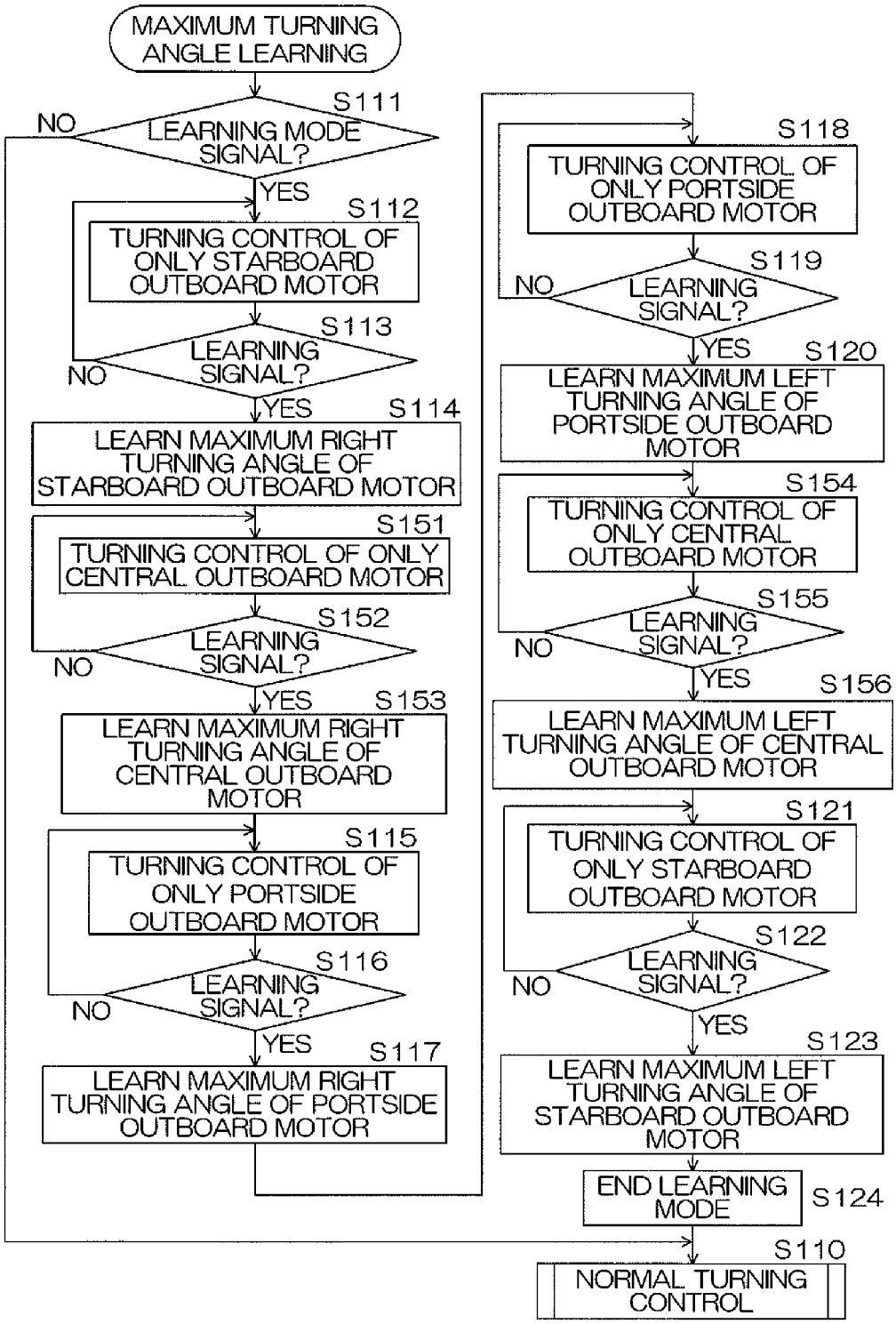
FIG. 22 is a flowchart for describing learning processing for setting maximum right turning angles and maximum left turning angles in the second preferred embodiment.

FIG. 22 is a flowchart for describing learning processing (function as the maximum turning angle acquisition unit 46) for setting maximum right turning angles and maximum left turning angles. In this FIG. 22, steps at which processes corresponding to the steps shown in FIG. 11 described above are designated with the same reference symbols.

When a learning mode signal is input (Step S111: YES), the controller 6 performs processing for learning the maximum right turning angle δRmax_r of the starboard outboard motor 3R first (Steps S112 to S114).

Next, the controller 6 turns into a state in which the controller controls only the turning mechanism 4C for the central outboard motor 3C (Step S151). Specifically, the controller 6 controls only the central turning mechanism 4C according to the steering angle detected by the steering angle sensor 56. An adjustment operator rotates the steering handle 5*a* clockwise while visually confirming the turning state of the central outboard motor 3C to turn the central outboard motor 3C to a maximum right turn position at which a minimum clearance can be secured between the central outboard motor 3C and the starboard outboard motor 3R which has turned to the maximum right turning angle. In this state, the operator supplies a learning signal to the controller 6 from a predetermined setting device (Step S152). In response to this learning signal, the controller 6 acquires a central turning angle δC detected by the turning angle sensor 30C of the central turning mechanism 4C. Then, the controller 6 stores the acquired central turning angle δC in the memory 6M as a maximum right turning angle δCmax_r for the central outboard motor 3C. Thus, the maximum right turning angle δCmax_r for the central outboard motor 3C is learned (Step S153).

Next, the controller 6 performs processing for learning the maximum right turning angle δLmax_r for the portside outboard motor 3L (Steps S115 to S117). In this case, the adjustment operator rotates the steering handle 5*a* clockwise while visually confirming the turning state of the portside outboard motor 3L to turn the portside outboard motor 3L to a maximum right turn position at which a minimum clearance can be secured between the portside outboard motor 3L and the central outboard motor 3C which has turned to the maximum right turning angle.

Next, the same operation is also performed for left turning the outboard motors 3L, 3C, and 3R.

Specifically, first, the controller 6 performs processing for learning the maximum left turning angle δLmax_l for the portside outboard motor 3L (Steps S118 to S120).

Next, the controller 6 performs turning control of only the central outboard motor 3C (Step S154). Specifically, the controller 6 controls only the central turning mechanism 4C according to a steering angle detected by the steering angle sensor 5*b*. The adjustment operator rotates the steering handle 5*a* counterclockwise while visually confirming the turning state of the central outboard motor 3C to turn the central outboard motor 3C to a maximum left turn position at which a minimum clearance can be secured between the central outboard motor 3C and the portside outboard motor 3L which has turned to the maximum left turning angle. In this state, the operator supplies a learning signal to the controller 6 from the setting device (Step S155). In response to this learning signal, the controller 6 acquires a central turning angle δC detected by the turning angle sensor 30C of the central turning mechanism 4C. Then, the controller 6 stores the acquired central turning angle δC in the memory 6M as a maximum left turning angle δCmax_l for the central outboard motor 3C. Thus, the maximum left turning angle δCmax_l for the central outboard motor 3C is learned (Step S156).

Subsequently, the controller 6 performs processing for learning a maximum left turning angle δRmax_l for the starboard outboard motor 3R (Steps S121 to S123). In this case, the adjustment operator rotates the steering handle 5*a* counterclockwise while visually confirming the turning state of the starboard outboard motor 3R to turn the starboard outboard motor 3R to a maximum left turn position at which a minimum clearance can be secured between the starboard outboard motor 3R and the central outboard motor 3C which has turned to the maximum left turning angle.

When learning of maximum left and right turning angles of all outboard motors 3L, 3C, and 3R is thus finished, the controller 6 ends the learning mode (Step S124) and switches the process to normal turning control (Step S110).

Next, adjustments of clearances between the outboard motors when starting turning controls (function as the clearance adjustment unit 45) will be described. A clearance adjustment operation in the three-outboard motor equipped arrangement is similar to the two-outboard motor equipped arrangement described above based on FIG. 12A, FIG. 12B, and FIG. 13 although it is not shown in detail.

In some cases, the clearance between the portside outboard motor 3L and the central outboard motor 3C may be excessively small, proper, or excessively large, and in some cases, the clearance between the central outboard motor 3C and the starboard outboard motor 3R may be excessively small, proper, or excessively large. Therefore, these cases can be classified as shown in the Table 1 below.

TABLE 1

| Number | Between portside and central | Between central and starboard |
|---|---|---|
| (1) | Excessively small | Excessively small |
| (2) | Excessively small | Proper |
| (3) | Excessively small | Excessively large |
| (4) | Proper | Excessively small |
| (5) | Proper | Proper |
| (6) | Proper | Excessively large |
| (7) | Excessively large | Excessively small |
| (8) | Excessively large | Proper |
| (9) | Excessively large | Excessively large |

The clearance adjustment operation in the case of (1) is as follows. That is, when the steering handle 5*a* is steered clockwise, the controller 6 performs turning control of only the starboard outboard motor 3R first to make the clearance between the central outboard motor 3C and the starboard outboard motor 3R proper. Thereafter, the controller 6 performs synchronous turning control of the central outboard motor 3C and the starboard outboard motor 3R without turning the portside outboard motor 3L to make the clearance between the central outboard motor 3C and the portside outboard motor 3L proper. Thereafter, the controller 6 performs synchronous turning control of the three outboard motors 3L, 3C, and 3R. On the other hand, when the steering handle 5*a* is steered counterclockwise, the controller 6 performs turning control of only the portside outboard motor 3L first to make the clearance between the portside outboard motor 3L and the central outboard motor 3C proper. Thereafter, the controller 6 performs synchronous turning control of the portside outboard motor 3L and the central outboard motor 3C without turning the starboard outboard motor 3R to make the clearance between the central outboard motor 3C and the starboard outboard motor 3R proper. Thereafter, the controller 6 performs synchronous turning control of the three outboard motors 3L, 3C, and 3R.

The clearance adjustment operation in the case of (2) is as follows. That is, when the steering handle 5*a* is steered clockwise, the controller 6 performs synchronous turning control of the central outboard motor 3C and the starboard outboard motor 3R without turning the portside outboard motor 3L to make the clearance between the central outboard motor 3C and the portside outboard motor 3L proper. Thereafter, the controller 6 performs synchronous turning control of the three outboard motors 3L, 3C, and 3R. On the other hand, when the steering handle 5*a* is steered counterclockwise, the controller 6 performs turning control of only the portside outboard motor 3L first to make the clearance between the portside outboard motor 3L and the central outboard motor 3C proper. Thereafter, the controller 6 performs synchronous turning control of the three outboard motors 3L, 3C, and 3R.

The clearance adjustment operation in the case of (3) is as follows. That is, when the steering handle 5*a* is steered clockwise, the controller 6 performs turning control of only the central outboard motor 3C first to make the clearance between the central outboard motor 3C and the starboard outboard motor 3R proper. During this time, the controller 6 monitors whether the clearance between the portside outboard motor 3L and the central outboard motor 3C becomes proper. If the clearance between the portside outboard motor 3L and the central outboard motor 3C is made proper before the clearance between the central outboard motor 3C and the starboard outboard motor 3R is made proper, thereafter, the controller 6 performs synchronous turning control of the three outboard motors 3L, 3C, and 3R. On the other hand, in some cases, even after the clearance between the central outboard motor 3C and the starboard outboard motor 3R is made proper, the clearance between the portside outboard motor 3L and the central outboard motor 3C is still excessively small. In this case, the controller 6 performs synchronous turning control of the central outboard motor 3C and the starboard outboard motor 3R without turning the portside outboard motor 3L to make the clearance between the central outboard motor 3C and the portside outboard motor 3L proper. Thereafter, the controller 6 performs synchronous turning control of the three outboard motors 3L, 3C, and 3R. On the other hand, when the steering handle 5*a* is steered counterclockwise, the controller 6 performs turning control of only the portside outboard motor 3L first to make the clearance between the portside outboard motor 3L and the central outboard motor 3C proper. Thereafter, the controller 6 turns only the starboard outboard motor 3R to make the clearance between the central outboard motor 3C and the starboard outboard motor 3R proper. Thereafter, the controller 6 performs synchronous turning control of the three outboard motors 3L, 3C, and 3R.

The clearance adjustment operation in the case of (4) is as follows. That is, when the steering handle 5*a* is steered clockwise, the controller 6 performs turning control of only the starboard outboard motor 3R first to make the clearance between the central outboard motor 3C and the starboard outboard motor 3R proper. Thereafter, the controller 6 performs synchronous turning control of the three outboard motors 3L, 3C, and 3R. On the other hand, when the steering handle 5*a* is steered counterclockwise, the controller 6 performs synchronous turning control of the portside outboard motor 3L and the central outboard motor 3C without turning the starboard outboard motor 3R to make the clearance between the central outboard motor 3C and the starboard outboard motor 3R proper. Thereafter, the controller 6 performs synchronous turning control of the three outboard motors 3L, 3C, and 3R.

In the case of (5), clearance adjustments are not necessary, so that the controller 6 performs synchronous turning control of the three outboard motors 3L, 3C, and 3R in response to the operation of the steering handle 5*a* from the beginning.

The clearance adjustment operation in the case of (6) is as follows. That is, when the steering handle 5*a* is steered clockwise, the controller 6 performs synchronous turning control of the portside outboard motor 3L and the central outboard motor 3C first without turning the starboard outboard motor 3R to make the clearance between the central outboard motor 3C and the starboard outboard motor 3R proper. Thereafter, the controller 6 performs synchronous turning control of the three outboard motors 3L, 3C, and 3R. On the other hand, when the steering handle 5*a* is steered counterclockwise, the controller 6 performs turning control of only the starboard outboard motor 3R first to make the clearance between the starboard outboard motor 3R and the central outboard motor 3C proper. Thereafter, the controller 6 performs synchronous turning control of the three outboard motors 3L, 3C, and 3R.

The clearance adjustment operation in the case of (7) is as follows. That is, when the steering handle 5*a* is steered clockwise, the controller 6 performs turning control of only the starboard outboard motor 3R first to make the clearance between the starboard outboard motor 3R and the central outboard motor 3C proper. Thereafter, the controller 6 turns only the portside outboard motor 3L to make the clearance between the portside outboard motor 3L and the central outboard motor 3C proper. Thereafter, the controller 6 performs synchronous turning control of the three outboard motors 3L, 3C, and 3R. On the other hand, when the steering handle 5*a* is steered counterclockwise, the controller 6 performs turning control of only the central outboard motor 3C first to make the clearance between the central outboard motor 3C and the portside outboard motor 3L proper. During this time, the controller 6 monitors whether the clearance between the starboard outboard motor 3R and the central outboard motor 3C becomes proper. If the clearance between the starboard outboard motor 3R and the central outboard motor 3C is made proper before the clearance between the central outboard motor 3C and the portside outboard motor 3L is made proper, thereafter, the controller 6 performs synchronous turning control of the three outboard motors 3L, 3C, and 3R. On the other hand, in some cases, even after the clearance between the central outboard motor 3C and the portside outboard motor 3L is made proper, the clearance between the starboard outboard motor 3R and the central outboard motor 3C is still excessively small. In this case, the controller 6 performs synchronous turning control of the central outboard motor 3C and the portside outboard motor 3L without turning the starboard outboard motor 3R to make the clearance between the central outboard motor 3C and the starboard outboard motor 3R proper. Thereafter, the controller 6 performs synchronous turning control of the three outboard motors 3L, 3C, and 3R.

The clearance adjustment operation in the case of (8) is as follows. That is, when the steering handle 5*a* is steered clockwise, the controller 6 performs turning control of only the portside outboard motor 3L first to make the clearance between the portside outboard motor 3L and the central outboard motor 3C proper. Thereafter, the controller 6 performs synchronous turning control of the three outboard motors 3L, 3C, and 3R. On the other hand, when the steering handle 5*a* is steered counterclockwise, the controller 6 performs synchronous turning control of the starboard outboard motor 3R and the central outboard motor 3C first without turning the portside outboard motor 3L to make the clearance between the central outboard motor 3C and the portside outboard motor 3L proper. Thereafter, the controller 6 performs synchronous turning control of the three outboard motors 3L, 3C, and 3R.

The clearance adjustment operation in the case of (9) is as follows. That is, when the steering handle 5*a* is steered clockwise, the controller 6 performs turning control of only the portside outboard motor 3L first to make the clearance between the portside outboard motor 3L and the central outboard motor 3C proper. Thereafter, the controller 6 performs synchronous turning control of the portside outboard motor 3L and the central outboard motor 3C without turning the starboard outboard motor 3R to make the clearance between the central outboard motor 3C and the starboard outboard motor 3R proper. Thereafter, the controller 6 performs synchronous turning control of the three outboard motors 3L, 3C, and 3R. On the other hand, when the steering handle 5*a* is steered counterclockwise, the controller 6 performs turning control of only the starboard outboard motor 3R first to make the clearance between the central outboard motor 3C and the starboard outboard motor 3R proper. Thereafter, the controller 6 performs synchronous turning control of the starboard outboard motor 3R and the central outboard motor 3C without turning the portside outboard motor 3L to make the clearance between the central outboard motor 3C and the portside outboard motor 3L proper. Thereafter, the controller 6 performs synchronous turning control of the three outboard motors 3L, 3C, and 3R.

When only a portion of the outboard motors is turned for clearance adjustment, this may be notified to the steering operator in the same manner as in, for example, the case of the two-outboard motor equipped arrangement. This notification may be performed by actuating (turning on or flashing) the indicator lamp 50 (see FIG. 15) disposed on the steering seat. Of course, similar notification can be performed with another notifying unit such as a buzzer.

Figure 23:
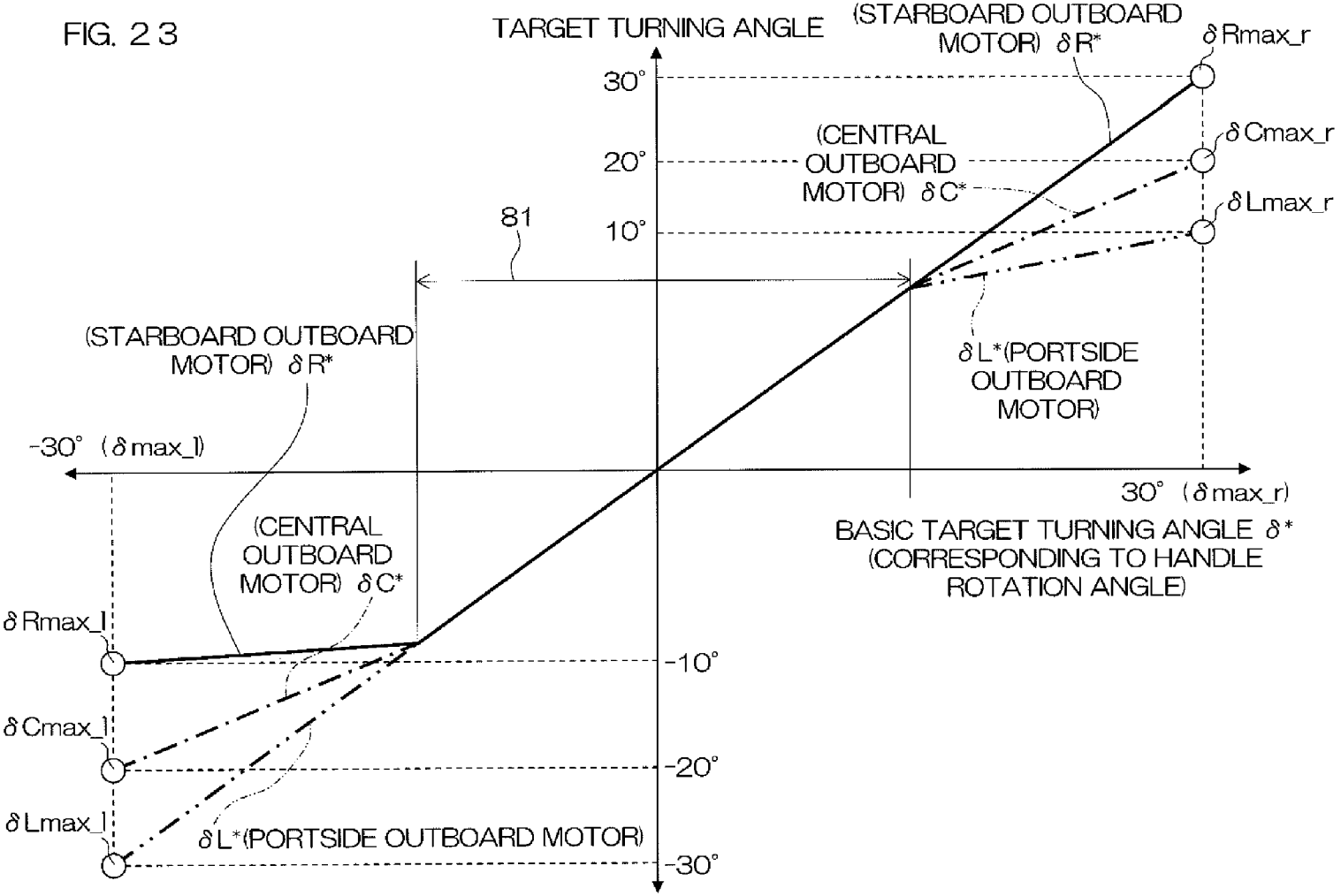
FIG. 23 is a view for describing another setting example of a portside target turning angle and a starboard target turning angle.

FIG. 23 is a view for describing another setting example of a portside target turning angle and a starboard target turning angle. This setting example is similar to that in the case of FIG. 14 described above, and the predetermined turning angle range around the turning angle neutral position (turning angle=0) is set as the equal turning angle region 81. The equal turning angle region 81 is a region in which the target turning angles δL*, δR*, and δC* of the left and right outboard motors 3L and 3R and the central outboard motor 3C are set to be equal to each other. This equal turning angle region 81 is a turning angle range in which the propeller center line directions of the outboard motors 3L, 3R, and 3C can be kept parallel or substantially parallel to each other while clearances are secured between the adjacent pairs of the outboard motors. In the equal turning angle region 81, the target turning angles δL*, δR*, and δC* are set to be equal to the basic target turning angle δ*.

On the right side of the equal turning angle region 81, the starboard target turning angle δR*, the portside target turning angle δL*, and the central target turning angle δC* are determined so as to linearly change to the respective maximum right turning angles δRmax_r, δLmax_r, and δCmax_r. Similarly, on the left side of the equal turning angle region 81, the starboard target turning angle δR*, the portside target turning angle δL*, and the central target turning angle δC*are determined so as to linearly change to the respective maximum left turning angles δRmax_l, δLmax_l, and δCmax_l.

Two preferred embodiments of the present invention are described above; however, the present invention can be carried out in many other preferred embodiments and modifications and combinations thereof. For example, in the preferred embodiments described above, an outboard motor malfunctioning in turning angle control is preferably turned to a predetermined non-interference turning angle. However, turning angle control of this outboard motor may be stopped at a timing at which the malfunction is detected. In this case, according to a turning angle of the outboard motor at the malfunction detection timing, turning angle range of other normally functioning outboard motor is limited.

In the preferred embodiments described above, when an outboard motor malfunctioning in turning angle control is turned to a non-interference turning angle, propulsion force generation of this outboard motor is preferably stopped. However, it is also possible that propulsion force generations of all the outboard motors including the malfunctioning outboard motor are temporarily stopped.

In the preferred embodiments described above, an electric motor is preferably use as a turning actuator, for example. However, another electric actuator such as a solenoid may be applied, or a hydraulic actuator may also be applied.

Further, in the preferred embodiments described above, a two-outboard motor equipped arrangement (first preferred embodiment) and a three-outboard motor equipped arrangement (second preferred embodiment) are described as examples. However, it is a matter of course that the present invention is also applicable to a marine vessel equipped with four or more outboard motors. In this case, for the inner side outboard motors between the extreme starboard and extreme portside outboard motors, center values (turning angles=0) of the turning angle ranges may be set as non-interference turning angles.

In the preferred embodiments described above, a clearance between outboard motors is preferably calculated by using outputs of the turning angle sensors 30. However, the clearance may be obtained by using another measuring unit such as a distance sensor, etc. In other words, it is also possible that a distance sensor arranged to measure a clearance between outboard motors is provided, and that, based on an output of the distance sensor, the clearance between the outboard motors is made proper. The clearance can also be made proper by using a distance sensor not only when starting turning angle control but also when learning maximum right and left turning angles of the outboard motors. In other words, the outboard motors may be turned into maximum turning states based on an output of the distance sensor, and outputs of the turning angle sensors 30 at this time may be loaded and learned.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application Nos. 2008-321079 and 2008-321080 both filed in the Japan Patent Office on Dec. 17, 2008, and the entire disclosures of the applications are incorporated herein by reference.

What is claimed is:

1. An outboard motor control device arranged to control a plurality of outboard motors, the outboard motor control device comprising:

a malfunction determination unit arranged to determine whether any of the plurality of outboard motors is malfunctioning in performing turning angle control and to identify a malfunctioning outboard motor;

a turning angle control stop unit arranged to stop turning angle control of the malfunctioning outboard motor;

a propulsion force control unit arranged and programmed to set a shift position of the malfunctioning outboard motor to a neutral position; and a turning angle control unit arranged and programmed to perform turning angle control of normally functioning outboard motors and not to perform turning angle control of the malfunctioning outboard motor; and a turnability determination unit arranged to determine whether the malfunctioning outboard motor is turnable; wherein the turning angle control stop unit is arranged to stop the turning angle control of the malfunctioning outboard motor when the malfunctioning outboard motor is determined to be not turnable by the turnability determination unit.

2. The outboard motor control device according to claim 1, wherein each of the plurality of outboard motors includes a motor and a propeller to be driven by the motor; and the neutral position is a shift position at which a driving force of the motor is not transmitted to the propeller such that generation of a propulsion force is stopped.

3. The outboard motor control device according to claim 2, wherein the propulsion force control unit is arranged and programmed to temporarily stop propulsion force generation of all the plurality of outboard motors including the malfunctioning outboard motor.

4. The outboard motor control device according to claim 1, wherein the plurality of outboard motors includes at least three outboard motors.

5. The outboard motor control device according to claim 1, wherein the plurality of outboard motors are not mechanically coupled to each other such that each of the plurality of outboard motors is turnable independently of others of the plurality of outboard motors.

6. The outboard motor control device according to claim 1, further comprising a plurality of turning actuators arranged to individually turn the plurality of outboard motors, wherein the outboard control device is arranged to control the plurality of turning actuators, and each of the plurality of turning actuators includes an electric motor.

7. The outboard motor control device according to claim 1, further comprising a plurality of turning actuators arranged to individually turn the plurality of outboard motors, wherein the outboard control device is arranged to control the plurality of turning actuators, and each of the plurality of turning actuators includes a hydraulic actuator.

8. An outboard motor control device arranged to control a plurality of outboard motors, the outboard motor control device comprising:

a malfunction determination unit arranged to determine whether any of the plurality of outboard motors is malfunctioning in performing turning angle control and to identify a malfunctioning outboard motor;

a turning angle control stop unit arranged to stop turning angle control of the malfunctioning outboard motor;

a propulsion force control unit arranged and programmed to set a shift position of the malfunctioning outboard motor to a neutral position; and a turning angle control unit arranged and programmed to perform turning angle control of normally functioning outboard motors and not to perform turning angle control of the malfunctioning outboard motor; wherein each of the plurality of outboard motors includes a motor and a propeller to be driven by the motor;

the neutral position is a shift position at which a driving force of the motor is not transmitted to the propeller such that generation of a propulsion force is stopped; and the propulsion force control unit is arranged and programmed to temporarily stop propulsion force generation of all the plurality of outboard motors including the malfunctioning outboard motor.

9. The outboard motor control device according to claim 8, wherein the plurality of outboard motors includes at least three outboard motors.

10. The outboard motor control device according to claim 8, wherein the plurality of outboard motors are not mechanically coupled to each other such that each of the plurality of outboard motors is turnable independently of others of the plurality of outboard motors.

11. The outboard motor control device according to claim 8, further comprising a plurality of turning actuators arranged to individually turn the plurality of outboard motors, wherein the outboard control device is arranged to control the plurality of turning actuators, and each of the plurality of turning actuators includes an electric motor.

12. The outboard motor control device according to claim 8, further comprising a plurality of turning actuators arranged to individually turn the plurality of outboard motors, wherein the outboard control device is arranged to control the plurality of turning actuators, and each of the plurality of turning actuators includes a hydraulic actuator.

* * * * *